US010829694B2

(12) United States Patent
Hunter

(10) Patent No.: US 10,829,694 B2
(45) Date of Patent: Nov. 10, 2020

(54) APPARATUS AND METHODS FOR SEPARATING HYDROCARBONS FROM PARTICULATES

(71) Applicant: 3P Technology Corp., Calgary (CA)

(72) Inventor: Trent Hunter, Calgary (CA)

(73) Assignee: 3P TECHNOLOGY CORP., Calgary (CA)

( * ) Notice: Subject to any disclaimer, the term of this patent is extended or adjusted under 35 U.S.C. 154(b) by 484 days.

(21) Appl. No.: 15/471,394

(22) Filed: Mar. 28, 2017

(65) Prior Publication Data

US 2017/0283705 A1 Oct. 5, 2017

Related U.S. Application Data

(60) Provisional application No. 62/314,720, filed on Mar. 29, 2016, provisional application No. 62/418,513, filed on Nov. 7, 2016.

(51) Int. Cl.
*C10G 1/04* (2006.01)
*E21B 21/06* (2006.01)

(52) U.S. Cl.
CPC ..... *C10G 1/045* (2013.01); *E21B 21/065* (2013.01); *C10G 2300/208* (2013.01)

(58) Field of Classification Search
None
See application file for complete search history.

(56) References Cited

U.S. PATENT DOCUMENTS 3,559,435 A 2/1971 Gerber
4,459,200 A 7/1984 Dente et al.
6,254,764 B1 * 7/2001 Babington ..... A62D 3/10 205/688
8,066,870 B2 11/2011 Freeman et al.
(Continued)

FOREIGN PATENT DOCUMENTS

CA 1058541 7/1979
CA 2866244 A1 9/2013
(Continued)

OTHER PUBLICATIONS

Genc, A., & Bakirci, B. 2015 Treatment of Emulsified Oils by Electrocoagulation: Pulsed Voltage Applications. Water Science and Technology 71.8, pp. 1196-1202.
(Continued)

*Primary Examiner* — Kishor Mayekar
(74) *Attorney, Agent, or Firm* — McCoy Russell LLP

(57) ABSTRACT

The invention relates to an apparatus and method for separating hydrocarbons from solid particles in a hydrocarbon-particulate-aqueous mixture. The apparatus comprises: a container for the mixture; a shockwave generator comprising two electrical terminals; and a pulsed power supply. The pulsed power supply is configured to apply a series of one or more voltage pulses to the terminals, such that, when each voltage pulse is applied to the terminals, a shockwave is applied to the mixture to promote separation of the components of the mixture. This may mitigate the need to heat the mixture and/or add chemicals to facilitate separation of hydrocarbons from solid particles such as sand or soil, mineral or carbonate particles.

19 Claims, 8 Drawing Sheets

(56) References Cited

U.S. PATENT DOCUMENTS

| | | | | |
|---|---|---|---|---|
| 2004/0052723 | A1* | 3/2004 | Jorgensen | B01J 7/02 423/648.1 |
| 2005/0042064 | A1* | 2/2005 | Kulbeth | B65G 33/10 414/319 |
| 2005/0113722 | A1 | 5/2005 | Schultheiss | |
| 2008/0190770 | A1 | 8/2008 | Daigle et al. | |
| 2010/0219136 | A1 | 9/2010 | Campbell et al. | |
| 2011/0266209 | A1* | 11/2011 | Cho | B01D 29/62 210/269 |
| 2012/0000642 | A1* | 1/2012 | Betzer Tsilevich | E21B 43/24 166/57 |
| 2012/0132731 | A1 | 5/2012 | Bentaj et al. | |
| 2012/0138421 | A1 | 6/2012 | Donchenko et al. | |
| 2013/0161251 | A1 | 6/2013 | Foret | |
| 2015/0014220 | A1 | 1/2015 | Schlosberg et al. | |
| 2015/0041127 | A1 | 2/2015 | Kuki et al. | |
| 2015/0307371 | A1 | 10/2015 | Fraim et al. | |

FOREIGN PATENT DOCUMENTS

| | | | |
|---|---|---|---|
| CA | 2907885 | A1 | 10/2014 |
| CN | 2780745 | Y | 5/2006 |
| CN | 103949131 | A | 7/2014 |
| CN | 104129833 | A | 11/2014 |
| GB | 2525097 | A | 10/2015 |
| KR | 101443883 | B1 | 9/2014 |
| RU | 2544649 | C1 | 3/2015 |
| SU | 904366 | A | 8/1983 |
| UA | 9451 | C2 | 5/2011 |
| WO | 2011025659 | A1 | 3/2011 |
| WO | 2012/125043 | A1 | 9/2012 |
| WO | 2013/064940 | A1 | 5/2013 |
| WO | 2013/139515 | A1 | 9/2013 |
| WO | 2015/148296 | A1 | 10/2015 |
| WO | 2015/156677 | A1 | 10/2015 |
| WO | 2015164760 | A1 | 10/2015 |

OTHER PUBLICATIONS

Locke, B.R. et al. Electrohydraulic Discharge and Nonthermal Plasma for Water Treatment. Industrial & Engineering Chemistry Research. 2006, vol. 45, pp. 882-905.

Bryden, Arthur. Liquid Arc Induced Cavitations (LAIC) System for Wastewater Treatment. [online] [retrieved on Apr. 24, 2017] Retrieved from: http://www.dajere.ca/LAIC%20Brief%20020411.pdf.

International Search Report for PCT/CA2017/050357 dated Jun. 22, 2017.

Written Opinion for PCT/CA2017/050357 dated Jun. 22, 2017.

Russian Federal Service for Intellectual Property, Office Action Issued in Application No. 2018135048/05(057665), dated Jun. 15, 2020, Saint-Petersburg, 12 pages.

* cited by examiner

APPARATUS AND METHODS FOR SEPARATING HYDROCARBONS FROM PARTICULATES

FIELD OF THE INVENTION

The invention relates to apparatus and methods for separating hydrocarbons such as bitumen from solid particles (or particulates), such as sand, soil, rock or sediment particulates. The invention may be used in a variety of oil-field, non-oilfield, industrial or environmental contexts. It will be appreciated that methods and apparatus for separating hydrocarbons from particulates may be used to separate particulates from hydrocarbons.

BACKGROUND OF THE INVENTION

In oil extraction, it is common for the crude hydrocarbons to be mixed with solid particles such as sand or rock or soils. This is particularly the case in oil sands formations, which inherently comprise sands, clays and other minerals.

Separating the oil from the solid particles may be further complicated in cases where the oil is made up of long-chain hydrocarbons (e.g. bitumen) which tend to be viscous and so adhere to any particulates within the oil-particulate mixture. Many hydrocarbon deposits that occur in near surface reservoirs have characteristically high molecular weight structures that make separating them from the inorganic reservoir material (e.g. rock particulates and sand) a difficult process. Indeed, the difficulties in separating heavy hydrocarbons from solid particles (e.g. in drill cuttings) mean that often hydrocarbons are not recovered from such oil-particulate waste mixtures.

For example, in the western Canadian sedimentary basin, currently the lowest cost solution for many operators is to stabilize their oil contaminated drill wastes with an absorbent material (i.e. wood chips) and transport it to a regulated waste management facility and limited or no hydrocarbon recapture is initiated or achieved.

Other methods of separating oil from solid particles include thermal desorption technology in which high amounts of mechanical energy is used to create friction forces to generate heat that is used to vaporize hydrocarbons off drill cuttings which vapors are subsequently condensed and reused or sold, and normally allows for the post treatment solids to be handled as "inert" non-dangerous waste and buried or land spread on/at site.

However, this type of technology has not been successful when used to treat SAGD oil laden drill cuttings. In particular, it was found that the oils from SAGD operations were too viscous to effectively vaporize and if too high temperatures, long residence times in the treater and high energy were used, hydrogen sulfide ($H_2S$) gas was formed which was dangerous for the operators. In addition, sand in SAGD drilling operations is abrasive and can damage devices which used mechanical shear heating elements.

More generally, the need for intensive energy addition may make the recovery of high molecular weight hydrocarbons more expensive than other known crude sources. Therefore an energy efficient process is desirable. In addition, it would be advantageous that any by-product of the process would be sufficiently non-hazardous so that they could be disposed of safely with limited further processing.

PRIOR ART

Vermeulen et al. in CA1058541A disclose a method and apparatus for separation of bitumen from tar sand involving an electric flotation cell formed of a container in which is placed a charge of unseparated tar sand to a first level and which is then filled with water to a second level and electrodes positioned in the cell in relation to the tar sand such that on application of a low voltage to the electrodes an electric current flows through the tar sand and water.

Jarvinen in CA2866244 describes a method and apparatus for extracting oil or bitumen from the soil comprising oil or bitumen or from the solid soil materials comprising oil or bitumen, such as oil sand or from ice, wherein oil or bitumen is extracted by using hot liquid so that the soil or soil material is brought in touch with hot liquid. The heat of the hot liquid extracts oil or bitumen from the soil or from the solid soil materials. Hot oil or hot water is pumped down into the soil or solid soil particles are dropped into hot oil or hot water.

Steinnes in WO 2012125043 discloses a method and a device for cleaning drill cuttings comprising cuttings and oil-based drilling mud, wherein a significant proportion of the drilling mud is removed from the drill cuttings, and wherein the method comprises:

- disposing the drill cuttings in a receptacle;
- vibrating the receptacle until particle fluidization of the drill cuttings takes place;
- maintaining the drill cuttings in a particle-fluidized state during the subsequent treatment;
- adding a soap to the drill cuttings;
- allowing the soap to flow through the drill cuttings whilst the drill cuttings are particle-fluidized;
- draining liquid from the receptacle; and then
- emptying cleaned drill cuttings out of the receptacle.

Genc, A. and Bakirci, B. "Treatment of emulsified oils by electrocoagulation: pulsed voltage applications", Water Science and Technology 71.8, 2015 (doi: 10.2166/wst.2015.092) describes the effect of pulsed voltage application on energy consumption during processing emulsified oils with electrocoagulation.

SUMMARY OF THE INVENTION

In accordance with the invention, there is provided an apparatus for separating hydrocarbons from solid particles in a hydrocarbon-particulate-aqueous mixture, the apparatus comprising:

a container for containing the hydrocarbon-particulate-aqueous mixture;

a shockwave generator comprising an electrical terminal pair located within the container;

a pulsed power supply configured to apply one or more voltage pulses to the electrical terminal pair;

the apparatus being configured such that, when a voltage pulse is applied to the electrical terminal pair, a shockwave is generated in the mixture to promote separation of the components of the mixture.

It will be appreciated that the pulsed power discharges between electrical terminal pairs of embodiments described herein is a complex electrical phenomena involving high rate transients. For example, the electrical discharge may cause one or more of the following:

- Shock and Acoustic Waves;
- Direct and Indirect Chemical effects: For example, this may create highly reactive hydroxyls (such as $O_3$, $OH^-$, $H_2O_2$ etc.) and cause covalent bond breaking; hydrolysis reactions; changes in pH; synthesis or analysis reactions; reduction-oxidation reactions.

Sonochemistry

Volumetric displacement enabling a form of agitation

Thermal Effects to bulk properties (e.g. heating may lower viscosity of heavy hydrocarbons);

Ionization from Electric Fields; and

Photochemistry (e.g. initiated by UV light).

One or more of these effects may combine to promote separation of the components in the hydrocarbon-particulate-aqueous mixture. That is, the energy contained in the electrical discharge between terminals may be distributed through one or more of the various mechanisms to the components of the hydrocarbon-particulate-aqueous mixture to effect separation.

It will be appreciated that how the energy from the electrical discharge is distributed may be dependent on the particular electrical characteristics of the components of the hydrocarbon-particulate-aqueous mixture (e.g. whether the components are conductors, insulators and/or dielectrics). The electrical discharge energy distribution may also be dependent on how the components of the hydrocarbon-particulate-aqueous mixture are spatially distributed. For example, small particulates may provide a large surface area for chemical reactions to occur.

The pulsed power supply may comprise a high-voltage power supply.

The terminal pair may comprise an electrode pair having a positive and a negative electrode positioned within the container and separated by a gap, such that when a high-voltage pulse is applied to the mixture, a plasma arc is generated between the electrodes which applies a shockwave to the mixture. The hydrocarbon-particulate-aqueous mixture itself may transmit the plasma arc to generate the shockwave.

The container may be considered to comprise one or more walls for constraining the mixture such that at least a portion is positioned between a terminal pair.

The voltage between the terminals in the terminal pair may be at least 18 kV. The voltage between the terminals in the terminal pair may be at least 35 kV. The voltage between the terminals in the terminal pair may be at most 50 kV. The voltage between the terminals in the terminal pair may be at most 60 kV. The voltage between the terminals in the terminal pair may be at most 100 kV. Lower voltages may reduce the rate of wear of one or more of the terminals. Lower voltages may reduce the need for electrical insulation and the power consumption. Higher voltage may produce stronger shock waves and/or facilitate different chemical reactions.

The voltage gradient between the terminals in the terminal pair may be between 39.4 kV/cm and 7.1 kV/cm. The voltage gradient between the terminals in the terminal pair may be at least 7.1 kV/cm. The voltage gradient between the terminals in the terminal pair may be at most 50 kV/cm (or at most 39.4 kV/cm).

The shockwave generator may be configured to receive a bridgewire between the terminals in the electrical terminal pair, the bridgewire being configured to explode in response to a voltage pulse being applied to the terminal pair which applies a shockwave to the mixture.

The apparatus may comprise a bridgewire replacing mechanism, the bridge wire replacer configured to replace the bridgewire after each voltage pulse.

The shockwave generator may comprise an ionic bridge injector configured to inject a solution of ionic solution between the electrical terminal pair of the shockwave generator such that when a voltage pulse is applied to the mixture, a plasma arc is generated between the electrical terminal pair which applies a shockwave to the mixture.

The ionic bridge injector may be configured to repeatedly inject a volume of ionic material to enable successive shockwaves to be generated by the shockwave generator.

The apparatus may comprise an agitator configured to mix and/or provide aggregate transport within the hydrocarbon-particulate-aqueous mixture.

The apparatus may comprise multiple terminal pairs.

Each voltage pulse may have an energy of at least 500 J.

The apparatus may be configured to apply a series of shockwaves to the mixture.

The temporal separation between successive shockwaves may be at most 5 seconds. The apparatus may be configured to deliver shockwaves at a frequency of around 5 per second or much faster.

The rise time of the leading edge of the voltage pulse may be less than 3 μs. The leading edge may be considered to be the time it takes for the pulse to ramp up to maximum voltage. The peak voltage rate of increase may be at least 2 kV/μs.

The distance between terminals in a said terminal pair may be between ¼ inch (0.635 cm) and 1 inch (2.54 cm). The distance between terminals in a said terminal pair may be between 1 inch (2.54 cm) and 2 inch (5.1 cm).

One of the terminals in a said terminal pair may be a point terminal and the other terminal in the terminal pair may be a plate terminal.

One of the terminals in a said terminal pair may be configured to move to agitate and/or translate the hydrocarbon-particulate-aqueous mixture within the container.

The mixture may be introduced into the container via a gravity feeding system and/or a pressure filling system (e.g. comprising a pump).

One of the terminals in a said terminal pair may form part of an auger, the auger being configured to agitate and translate the hydrocarbon-particulate-aqueous mixture through the container from an inlet to an outlet. The auger may be formed from a continuous helical flighting (or flight). The auger flighting may be a ribbon flighting (e.g. for use in very thick viscous mixtures). The auger may be shaftless. The liquid flow in above the augers may be either counter current or concurrent with the solids transport flow in the augers.

The auger may comprise a standard-pitch flight auger. Conveyor screws with pitch (e.g. distance for flighting to make 1 full turn) substantially equal to screw diameter are considered standard. They are suitable for a whole range of materials in most conventional applications.

The auger may comprise a short pitch auger. In this case, the flight pitch is reduced to a fraction (e.g. between ~⅔ diameter). This may be advantageous for inclined or vertical applications. Used in screw feeders. Shorter pitch reduces flushing of materials which fluidize.

The auger may comprise a half pitch auger. This auger is a particular variant of the short pitch auger where the pitch is reduced to ½ standard pitch. This may be useful for inclined applications, for screw feeders and for handling extremely fluid materials.

The auger may comprise a variable-pitch flight auger. Variable-pitch flights have variable, increasing or decreasing pitch and may be used in screw feeders, for example, to provide uniform withdrawal of fine, free flowing materials over the full length of the inlet opening.

The auger may comprise a double (or multiple) flight auger. Double (or multiple) flight augers may help provide smooth regular material flow and uniform movement of certain types or materials.

The auger may comprise a tapered flight auger. Tapered (or screw) flights increase or decrease in diameter along its length (e.g. from ⅔ to full diameter. These augers may be used in screw feeders to provide uniform withdrawal of lumpy materials. They may be more economical than variable pitch.

The auger may comprise a cut-flight auger. Cut-flights are notched at regular intervals at outer edge of these auger flightings. The notches may help mixing action and agitation of material in transit. These augers may be useful for moving materials which tend to pack.

The auger may comprise a cut & folded flight auger. These augers comprise folded flight segments configured to lift and spill the material. Partially retarded flow may help provide thorough mixing action. They may help heating, cooling or aerating light substances.

The auger may comprise a ribbon flight auger. Ribbon augers may be advantageous for conveying sticky or viscous materials. That is, the open space between the flighting and the pipe or shaft may help eliminate collection and build-up of material.

The auger may comprise one or more paddles. For example, adjustable paddles positioned between screw flights may be configured to oppose flow to provide gentle but thorough mixing action.

The auger can be operated in a negative angle (i.e. pushing solids downhill); a zero angle (horizontal) to a positive (uphill) angle up to 90° (vertical)

Flotation aids can be introduced at any low point along the vertical length of the auger.

The terminals may be located on or at the housing or container walls in any spatial array. For example, the terminals may or may not conform to a single linear line. The spatial separation between neighbouring electrodes may be different.

In multiple-terminal-pair embodiments, the energy deposition (e.g. pulsing strategy) for different terminal pairs may be different. For example, the pulse rate or energy distribution of different terminal pairs may be normally distributed, left or right biased or bi-modal or multi-modal to effect energy efficient separation of hydrocarbons in the mixture.

Opposed terminal pairs may be used anywhere outside the volume swept out by any auger flightings.

The apparatus may comprise a bulk separator comprising separate outlets for the particulate phase, the oil phase and the water phase.

The shock and/or acoustic waves may be applied to the mixture using a Lenoir-type thermodynamic cycle. In a Lenoir cycle, a material (e.g. a portion of the mixture or an ionic bridge) undergoes: substantially constant volume (isochoric) heat addition (in this case, the rapid heating by the plasma arc to form a gas filled channel or void which expands and creates a shockwave in the surrounding material); isentropic bubble expansion (which causes an acoustic wave in the surrounding material as the bubble volume increases to a maximum); and constant pressure (isobaric) heat rejection (where the bubble collapses also causing an acoustic wave in the surrounding material and the cycle can begin again). The drive velocity of the initial shock wave may be at least 1500 m/s. The drive velocity of the acoustic wave may be plus 10 m/s in bubble growth and minus 10 m/s in bubble collapse.

The apparatus may comprise one or more augers for moving the mixture with respect one or more stationary terminals.

The apparatus may comprise one or more augers for moving the mixture and the container walls are configured to be shaped to correspond to at least part of the circumference of the one or more augers.

According to a further aspect, there is provided a method for separating hydrocarbons from solid particles in a hydrocarbon-particulate-aqueous mixture, the method comprising:

applying a series of one or more voltage pulses between electrical terminals positioned within the hydrocarbon-mineral-aqueous mixture, such that, when a said voltage pulse is applied to the terminals, a shockwave is generated in the hydrocarbon-particulate-aqueous mixture which promotes separation of the components of the mixture.

The method may comprise adding water to a mixture comprising hydrocarbons and particulates such that water makes up at least 25% of the resulting mixture by volume. The water content may be no more than 90% of the mixture by volume.

The series of pulses may be configured to limit the temperature of the sample to no more than 50° C. The series of pulses may be configured to limit the temperature of the sample to no more than 85° C.

The solid particles may comprise soils or minerals. The solid particles may comprise rock fragments.

The hydrocarbons may comprise bitumen.

According to a further aspect there is provided An apparatus for separating hydrocarbons from solid particles in a hydrocarbon-particulate-aqueous mixture, the apparatus comprising:

a container for containing the hydrocarbon-particulate-aqueous mixture;

a shockwave generator configured to generate one or more shockwaves within the mixture in the container;

the apparatus being configured such that the generated shockwaves promote separation of the components of the mixture.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Introduction

Figure 1A:
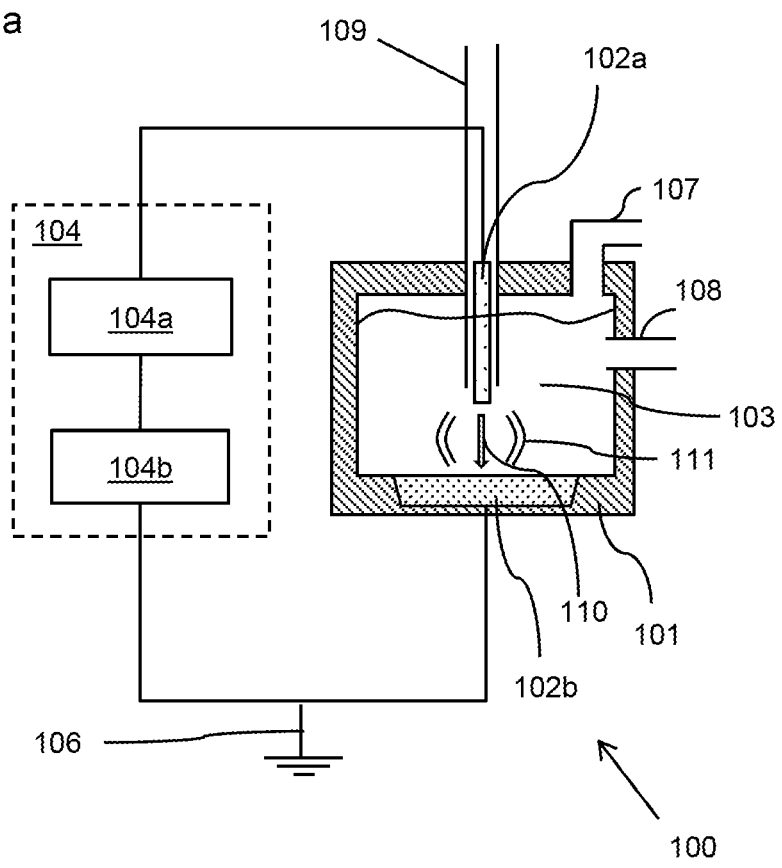
FIG. 1*a* is a schematic of an apparatus for separating hydrocarbons from solid particles using a plasma-arc generated shockwave.

The invention relates to apparatus and methods for separating hydrocarbons from solid particles in a hydrocarbon-particulate-aqueous mixture. With reference to the figures, these apparatus and methods used for separating hydrocarbons from solid particles are described. The apparatus and methods may be particularly applicable for separating heavy hydrocarbons, such as bitumen, from rock or mineral particulates such as sand or carbonates. The subject technology seeks to effect separation of hydrocarbons from solid particles whilst mitigating the need to use additives which may include chemicals potentially hazardous to the environment such as acids, bases, soap or ionic materials. The subject technology may also mitigate the need to supply external heat to the raw materials or provide high energy agitation to the treatment.

It will be appreciated that this technology may also work for separating lighter refined or crude oils from particulates. For example, lighter oils may include refined hydrocarbons such as diesel, and mineral oil or motor oils.

The apparatus comprises: a container for the mixture; a shockwave generator comprising two electrical terminals; and a pulsed power supply. The pulsed power supply is configured to apply a series of one or more voltage pulses to the terminals, such that, when each voltage pulse is applied to the terminals, a shockwave is applied to the mixture to promote separation of the components of the mixture. Using shockwaves may mitigate the need to heat the mixture and/or add chemicals to facilitate separation of hydrocarbons from solid particles such as sand, mineral or carbonate particles.

All terms used within this specification have definitions that are reasonably inferable from the drawings and description. In addition, the language used herein is to be interpreted to give as broad a meaning as is reasonable having consideration to the rationale of the subject invention as understood by one skilled in the art. It is also to be understood that prior art cited during prosecution of the subject patent application may not have been specifically identified prior to the drafting of the subject document and that various amendments may be introduced during prosecution that require amendment of terms to provide clarity to the distinctions between the subject invention and that prior art and that such amendments are reasonably inferable having consideration to the document as a whole and the rationale of the invention.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Within this specification embodiments have been described in a way which enables a clear and concise specification to be written, but it is intended and will be appreciated that embodiments may be variously combined or separated without parting from the invention. For example, it will be appreciated that all preferred features described herein may be applicable to all aspects of the invention described herein.

This technology may be used in a fixed plant or in a mobile processing and treatment unit (e.g. truck-based or ship-based embodiments) to treat "oil contaminated" drilling and production waste of upstream, refinery wastes and midstream wastes of oilfield operators. The present technology may be used to recover, for example, hydrocarbons from oil based drill cuttings and/or hydrocarbons from reservoir cuttings (e.g. in SAGD markets) and/or to clean contaminated solids after an oil spill (e.g. sand from a contaminated beach) or contaminated materials from tank bottoms or produced sand.

Plasma Arc Embodiment

FIG. 1*a* shows an embodiment of a separator apparatus 100 for separating hydrocarbons from solid particles in a hydrocarbon-particulate-aqueous mixture 103, the apparatus comprising:

a container 101 (e.g. a crucible, tank, channel or pipe) for containing the hydrocarbon-particulate-aqueous mixture;

a shockwave generator comprising a terminal pair 102 having a positive 102*b* and a negative 102*a* electrical terminal; and a pulsed power supply 104 configured to apply a voltage pulse between the positive and negative electrical terminals 102*a,b,* the apparatus being configured such that, when a voltage pulse is applied to the positive and negative electrical terminals, a shockwave is generated in the mixture to promote separation of the components of the mixture.

The pulsed power supply 104 is, in this case, a high-voltage power supply, and the terminal pair comprises an electrode pair 102 having a positive electrode 102*b* and a negative electrode 102*a* positioned within the container and separated by a gap, such that when a high-voltage pulse is applied to the mixture, a plasma arc is generated between the electrodes 102*a,b* within the hydrocarbon-particulate-aqueous mixture 103 which applies a shockwave to the mixture.

It will be appreciated that a pulsed power supply may comprise capacitors configured to store charge to deliver when the pulse is initiated.

The container may be as small as a few litres (e.g. 1 gallon or 4 litres), or may be significantly larger (e.g. 1000 litres or bigger). The container may be formed from steel (e.g. of thickness greater than ¼ inch or greater than ½ inch). It will be appreciated that the container should be configured to withstand the force of the shockwaves.

In this context, the negative electrode 102*a* is the cathode, because the negative electrode is the electrode from which a conventional current leaves the polarized electrical device (i.e. from which electrons are supplied). Likewise, in this context, the positive electrode 102*a* is the anode, because the positive electrode is the electrode from which a conventional current enters the polarized electrical device (i.e. into which electrons are received). It will be appreciated that positive and negative in this context means the relative charge with respect to the other electrode in the electrode pair.

In this case, one electrode of the electrode pair is a point electrode and the other electrode is a plate electrode. In this case, the negative (cathode) electrode 102*a* is the point electrode and the positive (anode) electrode 102*b* is the plate electrode. Because the point electrode may be hotter (e.g. due to resistive heating), it may be easier to eject electrons from the point electrode. By using at least one point electrode, rather than a parallel rod or parallel plate electrode pair, the position of the plasma arc is reproducible. In other embodiments, both electrodes of the electrode pair may comprise point electrodes. In other embodiments, where multiple plasma arcs are desired, or the position is less important, parallel rod or plate electrodes may be used.

A point electrode may be considered to be an electrode configured to discharge or receive electricity at a tip or end. A rod electrode may be considered to be an electrode configured to discharge or receive electricity along a length. A plate electrode may be considered to be an electrode configured to discharge or receive electricity on a surface. It will be appreciated that designating an electrode as a point, rod, or surface electrode may depend on the orientation of the electrode with respect to other electrode in a system. For example, two elongate electrodes may be considered point electrodes if they are arranged end to end coaxially; or as rod electrodes if arranged substantially parallel to each other; or as one rod and one point electrode if the arranged transverse to each other in the same plane.

The positive (anode) electrode in this case is attached to ground. This allows it to be incorporated into the chamber such that the electrode plate is in the same plane as the inner surface (e.g. bottom surface) of the container. This may allow the contents of the container (e.g. separated sand, water and/or oil) to be more easily removed.

The distance between the electrodes in this case is ½ inch (~1.3 cm). It will be appreciated that, in other embodiments, the distance between the electrodes may be between about ¼ and 1 inch (~0.6 cm-~2.5 cm) or between ¼ and ¾ inch (~0.6 cm-~1.9 cm).

As noted above, the anode in this case is grounded to earth 106. The other electrode is configured to provide a voltage between the electrodes of at least 18 kV (higher voltages may be used, e.g. at least 25 kV). It will be appreciated that other voltages may be applied to the electrodes. E.g. the electrodes may have a voltage of the same magnitude (with respect to ground) but opposite polarities. Some embodiments may be configured to vary the voltage output of the high-power voltage supply.

In this embodiment, a 23.5 kV voltage difference between the electrodes gives a voltage gradient between the two electrodes of 18.5 kV/cm (23.5 kV/½ inch). In other embodiments, the voltage gradient may be in the range between around 39.4 kV/cm (25 kV/¼ inch) and 7.1 kV/cm (18 kV/1 inch). It will be appreciated that embodiments with a higher voltage power supply may have larger inter-electrode spacing. It will be appreciated that some embodiments may allow the inter-electrode spacing to be adjusted (e.g. automatically depending on the composition of the hydrocarbon-particulate-aqueous mixture).

In this case, the high-voltage power supply 104, comprises a spark gap power switch 104*b* and a microcontroller 104*a*. Using a spark-gap power switch allows the pulse profile to have a rapidly increasing leading edge which helps facilitate formation of the plasma arc. The microcontroller 104 in this case is configured to produce a series of pulses (e.g. at 5 second intervals or much faster). It will be appreciated that the pulse train may be controlled using other circuits or processors (e.g. a microprocessor, an application-specific integrated circuit (ASIC), or a Multi-core processor). More rapid pulse trains may also be used. For example, the pulse frequency may be up to several pulses per second or faster.

Figure 1B:
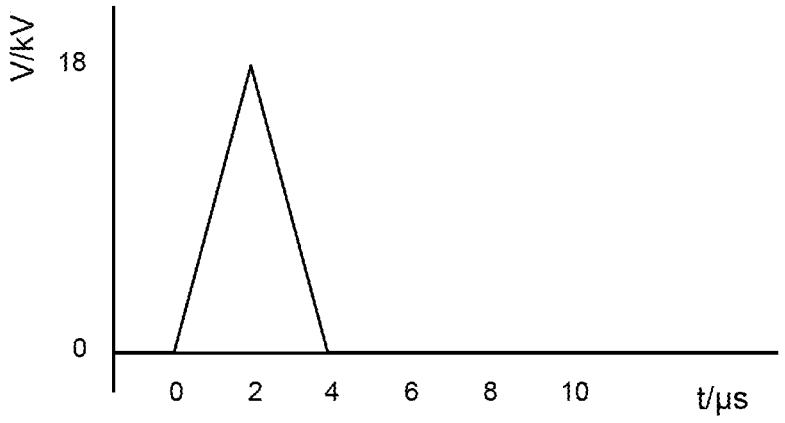
FIG. 1*b* is a schematic of a voltage pulse profile which is applied to the terminals of the embodiment of FIG. 1*a*.

The high-voltage power supply is configured to apply a series of high-voltage pulses to the sample (in this case 1 pulse is applied every 5 seconds). As shown in FIG. 1*b*, in this case, the leading edge of the voltage pulse is 2.66 μs. It will be appreciated that other rise times may be used, for example, between around 1-3 μs or faster. In this case, each pulse has an energy of at least 500 J. It will be appreciated that larger apparatus and/or larger inter-electrode spacing may require more energetic pulses (e.g. greater than 1000 J or greater than 3800 J).

In this case, the container also comprises a first inlet 107 for introducing the oil-particulate-aqueous mixture into the container 101. The container also comprises an outlet 108 for removing separated oil from the top of the container. It will be appreciated that other embodiments may also have an outlet for removing separated particles from the bottom of the container. In this case, the container also comprises a second inlet 109 for introducing water into the container. In this case, the second inlet extends into the container and is positioned to provide a stream of water into the volume of the container where the plasma arc will be produced. In effect, this inlet acts as an agitator to the contents of the container by agitating the contents using fluid flow. It will be appreciated that other embodiments may comprise one or more physical agitators (e.g. stirring rod, propeller, container rotator, stirrer or shaker). It will be appreciated that the agitator may be configured to agitate the contents of the container in the horizontal plane to help prevent mixing of strata in the container (e.g. to prevent mixing of layers of separated hydrocarbons and particulates).

It will be appreciated that one or more of the inlets and outlets may be connected with a pump to allow the contents of the container to be cycled to aid agitation, filling or discharging. For example, in one configuration and depending on the level of the contents, the contents of the container could be extracted from outlet 107 and reintroduced at inlet 109 to agitate the contents of the container. It will be appreciated that recycling of container contents may be directed to recycling non-separated components of the mixture.

In this case, the apparatus is configured to operate in a batch mode. That is, a hydrocarbon-particulate-aqueous mixture added to the container; separated using plasma arc induced shockwaves; and the separated products removed before further hydrocarbon-particulate-aqueous mixture is added. It will be appreciated that other embodiments may allow continuous operation where oil-particulate mixture may be continually added and separated oil and particles removed.

Method

In order to separate the hydrocarbons from the solid particles using the above described apparatus, the hydrocarbon-particulate mixture is introduced into the container via first inlet 107. Water is added to the mixture comprising hydrocarbons and solid particles via second inlet 109. This results in a hydrocarbon-particulate-aqueous mixture. As noted above adding water from inlet 107 may agitate the oil-particulate mixture. It will be appreciated that, in some cases such as SAGD embodiments, water may already be present in the mixture so no further water addition is required.

In this case, water is added so that water makes up at least 25% of the resulting mixture by volume but no more than 90% of the mixture by volume. A preferred range may be between 50% and 75%. This ensures enough water to generate a good shockwave and helps ensure that the shockwave interacts with hydrocarbon-particulate mixture. In this case, only water (e.g. pure water, fresh water, or natural water) is added to the mixture. Not using additives may mean that the water which is separated from the hydrocarbon-particulate mixture is cleaner, and so it may be easier to dispose of or recycle the water after use. Not using additives may make the method more cost effective.

An additive may be considered a chemical which is added to a bulk raw material to adjust the properties of the raw material. For example, additives may include surfactants and/or ionic materials or acids and bases. These additives may be potentially hazardous when by-products of the process are returned to the environment. That is, it is important for drilling operations that water by-products are clean as water processing is a significant technical and financial issue. It may also allow natural water sources to be used (e.g. rivers, lakes or seawater). It will be appreciated that in other embodiments, other chemicals (e.g. additives and/or solutes) may be added such as surfactants (e.g. soaps, such sodium stearate, to make the bitumen more hydrophilic) and/or salts or other ionic materials (e.g. to promote and/or control formation of the plasma arc).

A series of one or more high-voltage pulses is then applied to the hydrocarbon-mineral-aqueous mixture, such that, when a high-voltage pulse is applied to the mixture, a plasma arc 110 is generated between the electrodes 102*a,b* which applies a shockwave 111 to the mixture to cause separation of the components of the mixture. It will be appreciated that a shock wave travels faster than the speed of sound in the medium. A shockwave may also be considered to cause a step change in the density of the material before the shock front and the material behind the shock front. It will also be appreciated that a shock wave may be reflected and refracted as it interacts with different materials and material interfaces. For example, a shockwave may be partially reflected and partially transmitted by an interface between materials of different densities (e.g. between the water-hydrocarbon; hydrocarbon-particulate; and/or water-particulate interfaces). These properties may allow materials with different properties to be separated using a shock wave.

In addition to the shock wave, the plasma arc may form a bubble which expands with time. This expansion causes an acoustic wave to pass through the material. Like the shock wave, the sonic wave may also help to separate the hydrocarbons from the solid particles. It will be appreciated that the shock-wave, the acoustic wave, and/or movement of the bubbles may help agitate the mixture within the container.

Furthermore, a plasma arc may produce electromagnetic radiation in a range of frequencies (e.g. including one or more of IR, visible light and UV radiation). This radiation may help promote chemical reactions in the vessel (e.g. upgrading reactions and/or neutralizing potentially hazardous contaminants).

In addition, the plasma arc may ionize the water. This may help keep the particulates in the water phase and prevent the particulates rising to the top with the separated hydrocarbon.

The particulates in the aqueous mixture may retain a charge when exposed to an electric field and when the EM is removed the particulates discharge amongst themselves creating secondary ionization and arc discharges that generate localized effects as described in 13.

The plasma arc 110 and the resulting shock wave 111 may heat the mixture. However, the apparatus may be configured such that the series of pulses are configured to limit the temperature of the sample to no more than 60° C. (and/or the temperature rise to 40° C. above an ambient temperature of 20° C.). Limiting the amount of heating may reduce the need to cool the separated water before returning the water to the environment. It will be appreciated that the apparatus may comprise a thermometer (e.g. a thermocouple) to measure the temperature of the sample. The thermometer may be connected to the controller for controlling the high-voltage pulsed power supply to control the pulse train based on the temperature of the sample.

When the hydrocarbon has been separated from the solid particles, the hydrocarbons float to the top of the container as they are less dense than water when heated and the chemical changes in the water phase promote hydrophobicity. In contrast, the solid particles, which are denser than water, sink to the bottom of the container. This may facilitate continuous processing as the solid particles may be extracted from the bottom of the container and the hydrocarbons from the top as new hydrocarbon-particulate mixture is added to the container.

It will be appreciated that this method may be used with other embodiments configured to generate a shockwave in the mixture by different mechanisms. As discussed below other shockwave generating mechanisms include generating shockwaves using a bridgewire and/or an ionic bridge.

Experiments

To give a quantitative estimate of the quantity of hydrocarbon remaining in the particulates after separation using the process described above the following experiment was performed. First, approximately 50 bulk volume units of treated sand-aqueous mixture separated from bitumen by this process was added to 50 bulk volume units of room temperature toluene, with care taken to eliminate entrained air. The toluene dissolves the hydrocarbon components remaining on the treated aqueous-sand waste. The treated sand waste plus toluene mixture was trimmed or made up to 100 bulk volume units with normal tap water (which is immiscible with toluene).

This water-toluene-waste mixture is then agitated and mixed and finally separated by a centrifuge. The sample was then allowed to gravimetrically settle, thereby separating the various components. The sand (now solvent washed) settles at the bottom below a layer of water which is a combination of the added trim water plus water entrained in the treated aqueous-sand mixture. The toluene and dissolved hydrocarbon fraction floats at the top and the total volume of the mixture does not change. Any hydrocarbons remaining on the treated sand will be dissolved into the toluene and therefore the toluene fraction will increase.

The toluene-hydrocarbon fraction was found to be less than 50.5 bulk volume units. That is, the addition of the bitumen from the treated waste sand added less than 0.5 bulk units to the 50 bulk units of toluene originally used. The toluene, normally a clear liquid, turns black following mixing agitating and centrifugation. Therefore, the volume of bitumen on the sand separated using the process was found to be less than 1%. Using a calibrated centrifuge tube graduated in % makes a direct reading of hydrocarbon content remaining on the treated sand samples possible.

Another test was performed on another sample of a heavy oil and sand mixture largely according to US Environmental Protection Agency method 9071B (n-Hexane Extractable Material (HEM) for Sludge, Sediment, and Solid Samples, Revision 2, April 1998). However, in this test, the soils, sediments, and sludges were extracted using dichloromethane (DCM) rather than n-hexane followed by evaporation of the solvent and gravimetric analysis. Before separation the test found that hydrocarbons made up 14.0% of the dry weight of the sample. After separation the test found that hydrocarbons made up <0.1% of the dry weight of the sample. This represents removing 99.3% (=100%×(1−0.1%/14.0%)) of the hydrocarbons from the dry hydrocarbon-particulate mixture.

It will be appreciated that the effectiveness of the process may depend on: the nature and ratio of components in the initial mixture; the configuration of the separator apparatus (e.g. voltage used, inter-terminal spacing); and the process parameters used (e.g. number of shockwaves, shockwave frequency).

Visual inspection of the clean sand using a high-power microscope also indicates that the sand may be cleaned using this method.

Separation System

Figure 2:
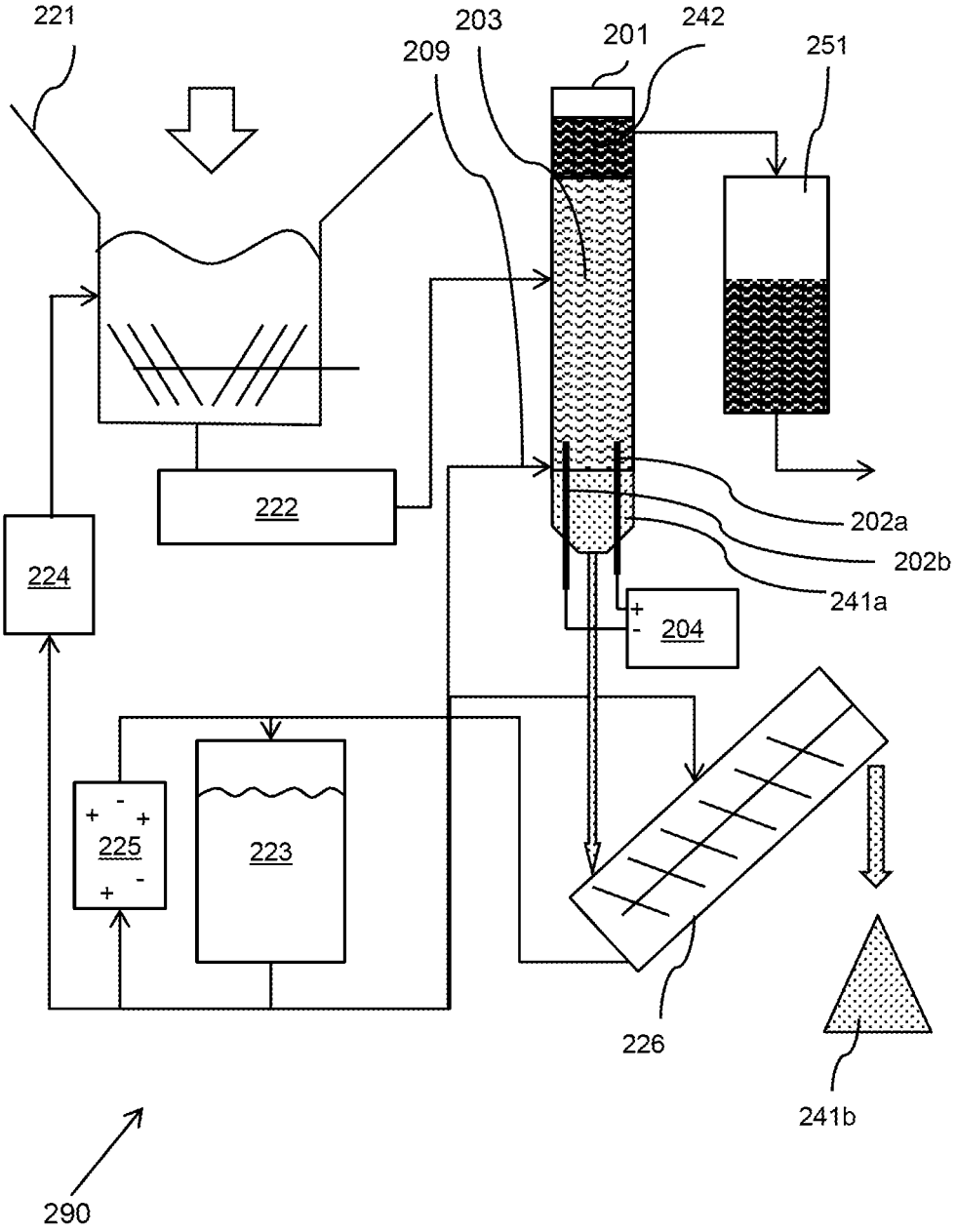
FIG. 2 is a schematic of a system for separating hydrocarbons from solid particles.

FIG. 2 illustrates a large-scale separation system. The system 290 comprises an apparatus for separating hydrocarbons from solid particles (SAGD drilling cuttings in this case) in a hydrocarbon-particulate-aqueous mixture, the apparatus comprising:

a container 201 (e.g. a tank) for containing the hydrocarbon-particulate-aqueous mixture;

an electrode (or terminal) pair 202*a,b* having a positive 202*a* and a negative 202*b* electrode within the container for applying a voltage to the mixture 209;

a high-voltage pulsed power supply 204 for applying a voltage pulse between the positive and negative electrodes, the apparatus being configured such that, when a high-voltage pulse is applied to the mixture, a plasma arc is generated between the electrodes which applies a shock-wave to the mixture to cause separation of the components of the mixture.

In addition, the system comprises a hopper 221 for receiving the drilling cuttings from the drilling operation or produced sand. It will be appreciated that other mixtures and sources of waste comprising hydrocarbons and solid particles may be used with this embodiment.

Water may also be added to the hopper 221. This additional water may help maintain fluidity of the mixture. The water added to the drilling cuttings at this stage may or may not be processed by adding chemicals using an optional water processor 224. Chemicals which may be added by the water processor 224 might include one or more of: diluent such as diesel to help dissolve heavy hydrocarbons; acids or alkalis (e.g. NaOH) for controlling pH and/or the ion content of mixture; and chelating agents for binding to metals (e.g. porphine, ethylenediamine, EDTA).

The hydrocarbon-particulate-aqueous mixture is then pumped into the container 201 using, for example, a trash pump 222 or other pump or conveyer capable of moving solid/liquid mixtures. It will be appreciated that, in other embodiments, the hydrocarbon-particulate mixture may be added directly to the container.

When in the container 201, the hydrocarbon-particulate-aqueous mixture is mixed and agitated using an agitator. The agitator may comprise a physical member which moves through the hydrocarbon-particulate-aqueous mixture 203. In this case, the agitator 209 comprises a water nozzle which agitates the hydrocarbon-particulate-aqueous mixture using a directed water stream. The water for the directed water stream may (or may not) come from the same water source 223 which is used to introduce water to the hopper 221.

Once inside the container 201, the hydrocarbon-particulate-aqueous mixture 203 is subjected to a series of shock waves, the shock waves having been generated by forming a plasma arc between the two electrodes 202*a,b*. In addition, the bubble expansion after the plasma arc has been generated causes an acoustic wave to extend outwardly from bubble. These supersonic and acoustic waves interact with the hydrocarbon-particulate-aqueous mixture 203 to separate the solid particles from the hydrocarbons.

It will be appreciated that other embodiments may have multiple electrode pairs. For example, one embodiment may have multiple cathodes and multiple corresponding anodes. Another embodiment may have multiple rod cathodes associated with a single plate anode. It will be appreciated that other embodiments may have multiple containers with respective electrode pairs. For example, the system may be a modular system which can be centrally controlled. Other variations would be apparent to the skilled person.

It will also be appreciated that the system may be adapted to use different shockwave generators. For example, one or more shockwaves may be generated using a bridgewire or an ionic bridge between the terminals.

After separation, the clean hydrocarbons 242 then float to the top of the water phase and can be extracted (e.g. into a separate hydrocarbon tank 251) to be sold as is or for further processing. The solid particles 241*a* sink to the bottom of the container (or remain suspended in the water phase).

After the solid particles have been removed from the bottom of the container, the grades of solid particles can be separated using a combination of one or more of: a sand separator 226; and a vibratory sand screen (not shown). The sand separator 226 may use centrifugal forces to separate sand from water. Additional water (e.g. from water source 223) may be added to further clean the sand to be separated.

The cleaned and processed solid particles 241*b* (e.g. sand), it may be repurposed as, for example, proppants in fracturing operations. Alternatively, the sand may be sufficiently clean to be classified as non-hazardous waste and so can be disposed in conventional landfill or used on site as a construction material or released back to the environment.

We note that the central water source may have an ionizer 225. The ionizer may be a passive catalytic element comprising multivalent metals (e.g. copper) which generates hydroxyl ions in the water when flowed through at certain pressures (the pressures may induce sonocavitation reactions). This may increase the oil hydrophobicity of the water. This may make it easier to skim the separated hydrocarbon layer from the surface of the water. In certain embodiments, the water processing may include water treatment technology configured to allow water reuse in the process. For example, water may be recaptured after use in the mixture or as a cleaning agent for the separated sand. This recaptured sand may be cleaned and returned to the water source and/or reused in the process.

It will be appreciated that the separation apparatus and/or system may be part of a fixed separation plant (e.g. as part of an oil drilling rig and/or refinery) or part of a mobile unit (e.g. a ship, train, or truck based unit).

Bridgewire Embodiment

Figure 3:
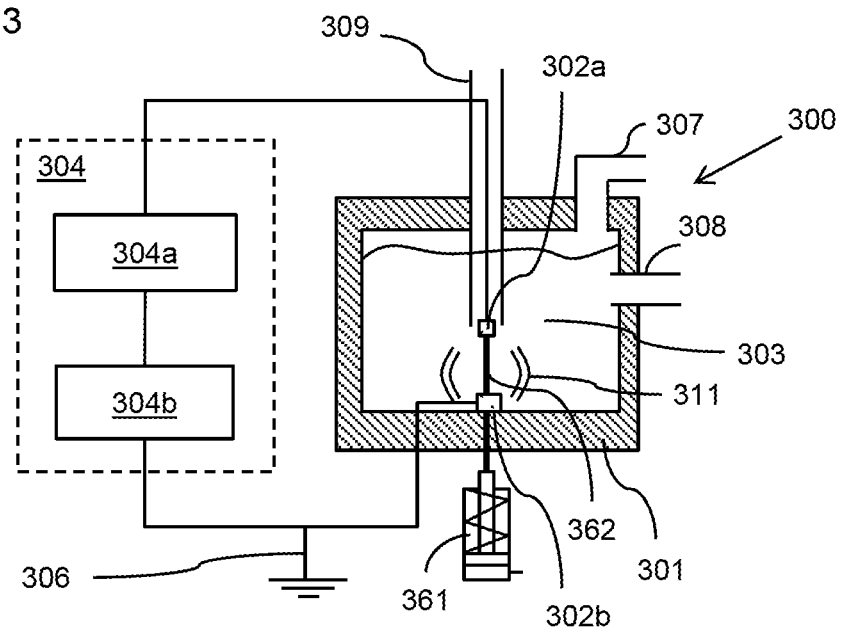
FIG. 3 is a schematic of a system for separating hydrocarbons from solid particles using a shockwave generated by a bridgewire.

FIG. 3 shows an alternative method of generating a shockwave in the mixture using a bridgewire. A bridgewire is a relatively thin resistance wire or filament configured to explode when a sufficiently high current is passed through the bridgewire. Such a bridgewire is also known as an exploding-bridgewire detonator.

In this case, the apparatus is similar to that shown in FIG. 1*a*.

FIG. 3 shows an embodiment of a separator apparatus 300 for separating hydrocarbons from solid particles in a hydrocarbon-particulate-aqueous mixture 303, the apparatus comprising:

a container 301 (e.g. a crucible or tank) for containing the hydrocarbon-particulate-aqueous mixture;

a shockwave generator comprising a terminal pair 302 having a positive 302*b* and a negative electrical terminal 302*b,* a pulsed power supply 304 for applying a voltage pulse between the positive and negative electrical terminals;

the apparatus being configured such that, when a voltage pulse is applied to the positive and negative electrical terminals, a shockwave is generated in the mixture to promote separation of the components of the mixture.

In this case, the positive terminal in this case is grounded to earth 306. The other terminal is configured to provide a voltage between the terminals of between 2-5 kV (or greater). It will be appreciated that other voltages may be applied to the terminals. E.g. the terminals may have a voltage of the same magnitude (with respect to ground) but opposite polarities. Some embodiments may be configured to vary the voltage output of the voltage supply.

Unlike the previous embodiment in which the space between the terminals was an open circuit, in this case the circuit is shorted between the terminals by a bridgewire 362. The bridgewire 362 may be formed by a metal such as gold, platinum, gold/platinum alloys, copper, silver, 302-stainless steel, iron or iron alloys. The wire may be between 0.03-0.6 mm in diameter (e.g. 0.038 mm or 0.02 inch).

When the voltage pulse is applied to the bridgewire 362, the bridgewire 362 is configured to explode and generate a shockwave. The explosion may be caused by the wire heating with the passing current until melting point is reached. The heating rate is high enough that the liquid metal has no time to flow away, and heats further until it vaporizes. During this phase the electrical resistance of the bridgewire assembly rises. Then an electric arc forms in the metal vapor, leading to: a drop of electrical resistance and sharp growth of the current; rapid further heating of the ionized metal vapor; and formation of a shock wave. In any case, it will be appreciated that using a bridgewire 362 may allow lower voltages (e.g. 2-5 kV or 4-5 kV) to create a shockwave.

After the bridgewire has exploded creating a shockwave (and possibly a bubble and acoustic wave), the terminals are no longer shorted by the bridgewire. In order to facilitate repeated shockwaves, some embodiments may comprise a bridgewire replacing mechanism 361, the bridgewire replacer configured to replace the bridgewire after each shockwave. For example, the terminals may comprise receiver clamps to receive and connect electrically to a replacement bridgewire as it is brought into position by a bridgewire positioner. The bridgewire replacer may comprise any mechanical device that extrudes or injects wire until the inter-terminal gap is bridged. For example the bridgewire replacer may comprise stepper motors or a linear actuator configured to move the replacement bridgewire into position.

The pulsed power supply 304, in this case comprises a spark gap power switch 304*b* and a microcontroller 304*a*. Using a spark-gap power switch allows the pulse profile to have a rapidly increasing leading edge. The microcontroller is configured to produce a series of pulses (e.g. at 5 second intervals or faster). It will be appreciated that the pulse train may be controlled using other circuits or processors (e.g. a microprocessor, an application-specific integrated circuit (ASIC), or a Multi-core processor).

As with the embodiment of FIG. 1*a,* the container in this case comprises: a first inlet 307 for introducing the oil-particulate mixture into the container 301; an outlet 308 for removing separated oil from the top of the container; and a second inlet 309 for introducing water into the container. In this case, the second inlet extends into the container and is positioned to provide a stream of water into the volume of the container where the spark gap will be produced. In effect, this inlet acts as an agitator to the contents of the container by agitating the contents using fluid flow.

Ion-Activated Plasma Arc Embodiment

Figure 4:
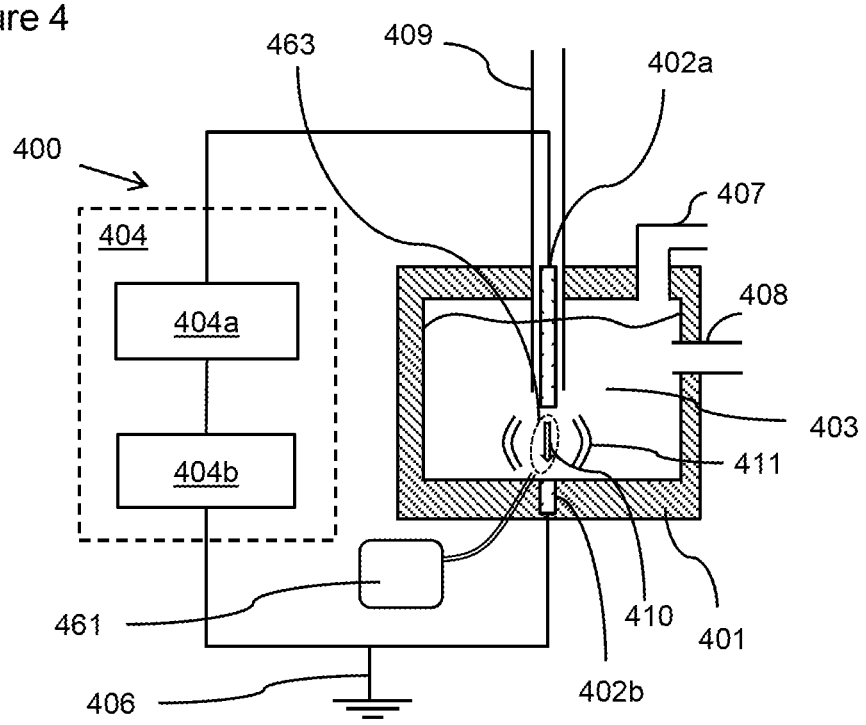
FIG. 4 is a schematic of a system for separating hydrocarbons from solid particles using a shockwave generated by an ionic bridge.

FIG. 4 shows an alternative method of generating a shockwave in the mixture using an activated plasma arc. The creation of the plasma arc 410 in this case is facilitated by injecting a conducting liquid (e.g. an ionic solution such as a salt (e.g. NaCl, KCl solution) between the terminals of the shockwave generator which may make the plasma arc easier to achieve without having to modify the conductivity of the entire bulk contents being treated thereby facilitating a more environmentally beneficial result for post treatment activities.

In this case, the apparatus is similar to that shown in FIG. 1*a.*

FIG. 4 shows an embodiment of a separator apparatus 400 for separating hydrocarbons from solid particles in a hydrocarbon-particulate-aqueous mixture 403, the apparatus comprising:

a container 401 (e.g. a crucible or tank) for containing the hydrocarbon-particulate-aqueous mixture;

a shockwave generator comprising a terminal pair 402 having a positive 402*b* and a negative electrical terminal 402*b,* a pulsed power supply 404 for applying a voltage pulse between the positive and negative electrical terminals;

the apparatus being configured such that, when a voltage pulse is applied to the positive and negative electrical terminals 402*a,b,* a shockwave is generated in the mixture to promote separation of the components of the mixture.

In this case, the apparatus comprises an ionic bridge injector 461 configured to inject a volume of ionic solution between the positive and negative electrical terminals of the shockwave generator such that when a voltage pulse is applied to the mixture, a plasma arc is generated between the terminals and through the volume of ionic solution 463 which applies a shockwave to the mixture. In this case, the ionic bridge injector comprises a reservoir for containing a quantity of ionic solution, a nozzle positioned within the container 401 to direct the ionic fluid between the terminals 402*a,b;* a fluid conduit for connecting the nozzle to the reservoir; and a metering pump (e.g. a syringe, a piston pump, a diaphragm or a peristaltic pump) configured to deliver a predetermined quantity of ionic solution from the reservoir to between the terminals 402*a,b* via the nozzle.

The ionic bridge injector in this case is configured to repeatedly inject a solution of ionic material to enable successive shockwaves to be generated by the shockwave generator. That is, the metering pump is configured to inject a quantity of ionic solution between the terminals 402*a,b* just in advance of each voltage pulse. This helps ensure that that the ionic solution is concentrated in the volume 463 between the terminals and so facilitates the formation of a plasma arc without having to increase the ionic concentration of the bulk mixture. That is, the timing of the injection of ionic material with respect to the voltage pulse is such that the ionic material is present between the terminals and has not had time to disperse when the voltage pulse is applied to the terminals 402*a,b*.

The positive terminal in this case is attached to ground 406. This allows it to be incorporated into the chamber such that the positive terminal is in the same plane as the inner surface (e.g. bottom surface) of the container. This may allow the contents of the container (e.g. separated sand, water and/or oil) to be more easily removed.

The distance between the terminals in this case is ½ inch (~1.3 cm). It will be appreciated that, in other embodiments, the distance between the terminals may be between about ¼ and 1 inch (~0.6 cm-~2.5 cm) or between ¼ and ¾ inch (~0.6 cm-~1.9 cm).

In this case, the anode in this case is grounded to earth 406. The other terminal is configured to provide a voltage between the terminals of between 2-5 kV (or greater).

In this case, the pulsed power supply 404, in this case comprises a spark gap power switch 404*b* and a microcontroller 404*a*. Using a spark-gap power switch allows the pulse profile to have a rapidly increasing leading edge. The microcontroller is configured to produce a series of pulses (e.g. at 5 second intervals or faster). It will be appreciated that the pulse train may be controlled using other circuits or processors (e.g. a microprocessor, an application-specific integrated circuit (ASIC), or a Multi-core processor).

The pulsed power supply is configured to apply a series of voltage pulses to the sample (in this case 1 pulse is applied every 5 seconds). In this case, the leading edge of the voltage pulse is 2 μs.

As with the embodiment of FIG. 1*a*, the container in this case comprises: a first inlet 407 for introducing the oil-particulate mixture into the container 401; an outlet 408 for removing separated oil from the top of the container; and a second inlet 409 for introducing water into the container. In this case, the second inlet extends into the container and is positioned to provide a stream of water into the volume of the container where the spark gap will be produced. In effect, this inlet acts as an agitator to the contents of the container by agitating the contents using fluid flow.

It will be appreciated that using a bridgewire or ionic bridge may help control the shockwave and produce more consistent shockwaves.

Container with Inclined Base

Figure 5:
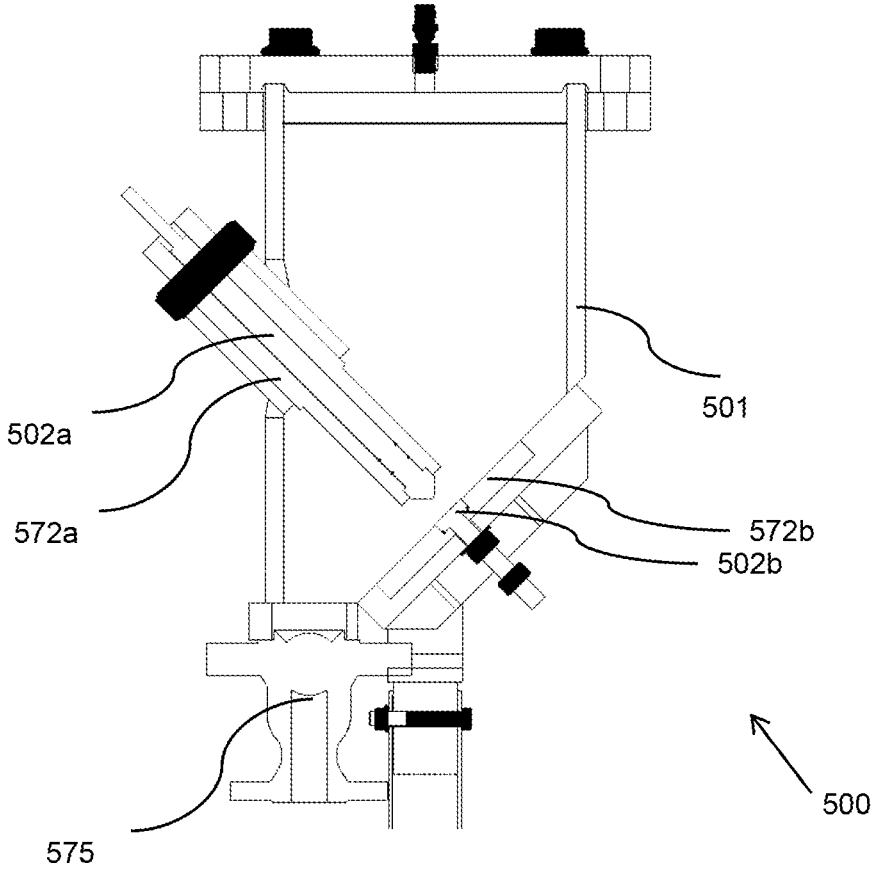
FIG. 5 is a cross-section view of a container and terminal assembly of an apparatus for separating hydrocarbons from solid particles using one or more shockwaves.

FIG. 5 shows a container 501 and terminal assembly 502*a*, 502*b* for a further embodiment 500. In this case, the base of the container 501 is inclined at an angle to allow the separated particulates to slide towards a valve 575 (or other outlet) to allow extraction of the separated solid particulates. In this case, one of the terminals 502*b* is located in the inclined base (or bottom surface). In this case, the bottom terminal 502*b* and the top terminal 502*a* are surrounded by an insulating layer 572*a*, 572*b*. It will be appreciated that, in other embodiments, a terminal may not be situated in the inclined base. In other embodiments, the terminals may be located on side walls of the container.

One-Auger Embodiment

Figure 6A:
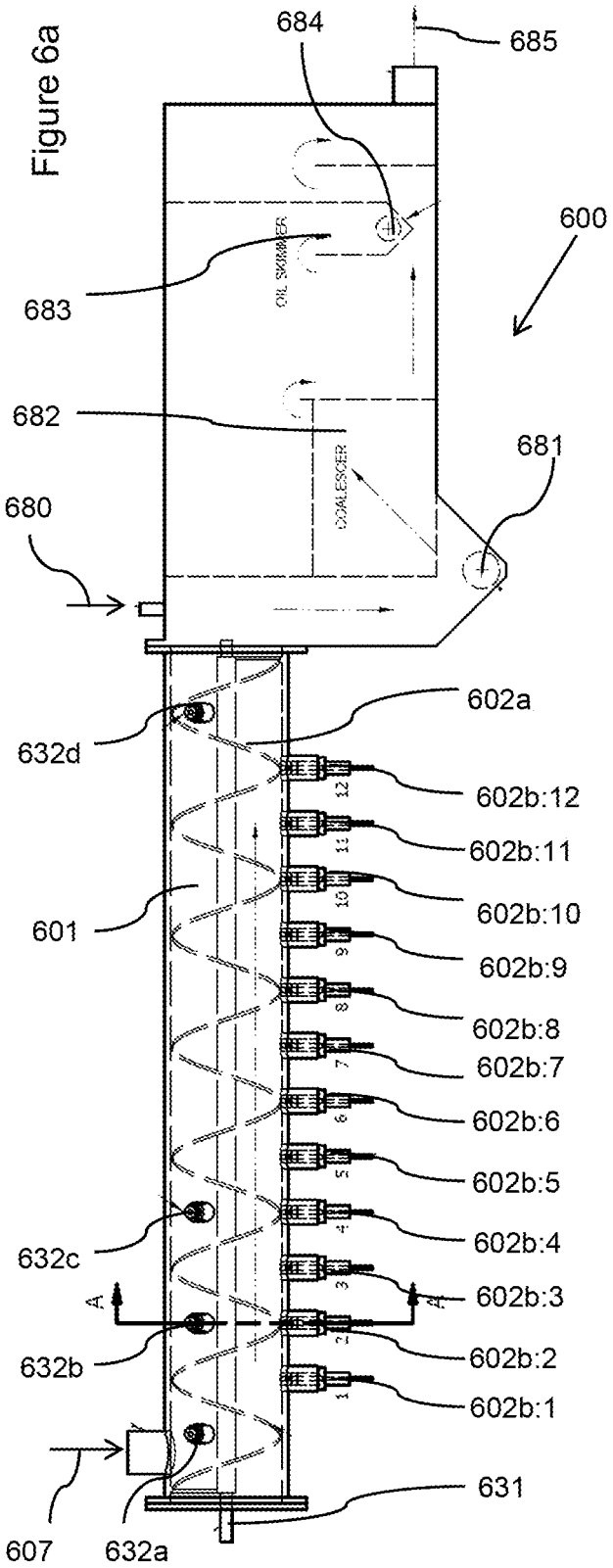
FIG. 6*a* is a side cross-section view of a separator apparatus separating hydrocarbons from solid particles using a shockwave.
Figure 6B:
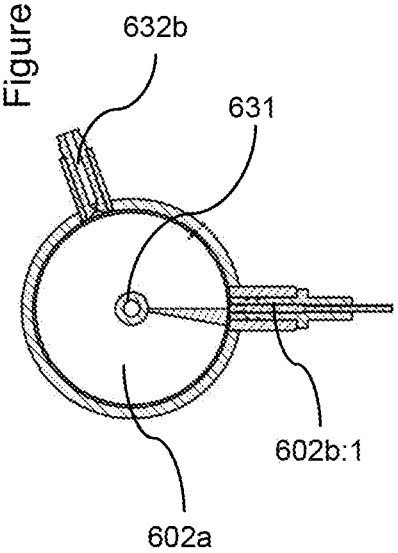
FIG. 6*b* is a transverse cross-section view of the separator apparatus of FIG. 6*a*.

FIG. 6*a* shows an embodiment of a separator apparatus 600 for separating hydrocarbons from solid particles in a hydrocarbon-particulate-aqueous mixture. FIG. 6*b* is a transverse cross-section of the separator shown at the position indicated by the line A-A.

In this case, the apparatus comprises:

a container 601 (in this case an enclosed pipe) for containing the hydrocarbon-particulate-aqueous mixture;

a shockwave generator comprising a terminal pair 602 having a positive 602*b*:1-12 and a negative 602*a* electrical terminals; and a pulsed power supply configured to apply a voltage pulse between the positive and negative electrical terminals 602*a, b,* the apparatus being configured such that, when a voltage pulse is applied to the positive and negative electrical terminals, a shockwave is generated in the mixture to promote separation of the components of the mixture.

In this case, the pipe container comprises an inlet 607 for introducing product into the container 901 (e.g. in a continuous manner).

Unlike the previous embodiments, this embodiment has multiple positive electrical terminals 602*b*:1-12 mounted on the container wall. It will be appreciated that The wall-mounted electrodes can be placed at any location around the housing and they form an array.

The negative terminal 602*a* in this case forms part of an auger. In particular, the auger flighting comprises the negative terminal. It will be appreciated that, in this case, there is a gap between the auger flighting to allow a "spark gap" between the positive and negative terminals. It will be appreciated that the auger terminal may have lower potential difference with respect to earth than the wall-mounted terminals to better control the spark discharge. The auger, or parts of the auger or auger flighting may be formed from materials more resistant to spark discharges (e.g. tungsten or tungsten alloys).

The auger, in this case, is 9" diameter. The auger may be configured to move 0.5 $m^3$/hr of 1,500-2,100 kg/$m^3$ slurry (hydrocarbon-particulate-aqueous mixture) at approximately 95% container loading. The material may have a retention time in the container of between 10 and 30 minutes (e.g. 20 min). It will be appreciated that, because the system is scalable, other design configurations (e.g. different diameter, length, auger helix angle etc.) are available depending on the desired outcomes. The apparatus, in this case, is generally formed from stainless steel.

In this case, the apparatus is configured to control pulse timing to trigger a pulse for particular positive electrodes when the auger flighting is directly adjacent with those positive electrode. For example, in the scenario shown in FIG. 6*a*, electrodes 602*b*:2, 4, 6, 8, 10 & 12 are activated to provide a pulse to the adjacent portions of the negative electrode 602*a*. At a later stage when the auger is rotated, portions of the auger electrode will align with electrodes 602*b*:1, 3, 5, 7, 9 & 11, at which point these electrodes will be activated. It will be appreciated that the helix angle of the auger and the side electrodes spacing can be controlled to change how many electrode pairs are aligned at a particular time. In addition, the drive shaft may be controlled in order to control when the auger electrode aligns with the side electrodes. For example, the auger may be paused in order to have repeated shocks between the electrodes when the auger is in a fixed position.

In this case, the auger electrode 602*a* is driven by a driveshaft 631 in order to move the product along the container and to agitate the product to aid separation. In this case, the auger and driveshaft are in a substantially horizontal configuration. It will be appreciated that rotation of the auger can be used to control flow within the container. For example, the auger may run in a continuous mode to translate the mixture through the container at a fixed rate. The auger may be configured to pause to restrict flow. The auger may be run in a retrograde mode to create further agitation (flow towards the outlet may still occur in the gap below the auger). These modes may be used interchangeably. For example, different modes may be employed depending on detected ratios between the various components in the mixture and/or operating conditions (e.g. temperature).

The pitch of the auger flighting and diameter of the auger may or may not be constant across its length (e.g. from inlet to outlet). In addition, in a vertical or horizontal, batch or continuous modes, fluid flow may be introduced at the bottom that could aid in washing the sand and floating the oil/bitumen off the top. For example, the introduced water may form a fluidized bed that suspends the solids or an air sparger to introduce atmospheric air under pressure to form bubbles that aid in floatation.

It will be appreciated that the auger apparatus may operate at any angle between horizontal (zero degrees) and vertical (90 degrees from horizontal). When operating in a vertical mode, the gap between the auger flighting and the container wall may be smaller.

It will be appreciated that in other embodiments, the auger and electrodes may be separate components. In other embodiments, the electrode may take a different form to provide agitation and/or translation of the mixture. For example, the apparatus may comprise a propeller, an impeller, an angled or straight rod or paddle wheel which may or may not comprise one or more electrodes. The apparatus may comprise a plurality of angled paddles connected to a common shaft at various axial positions.

In this case, while the mixture is moved along the container, water can be added through one or more spray nozzles or ports 632*a-d*. This allows the water component of the mixture to be controlled at different points along the axial direction of the container 601. It may also be used to clean/remove material (e.g. bitumen) from the auger.

Potential benefits of this design may include one or more of the following:

- it may allow for continuous processing and material flow and less capital expenditure than batch processing;
- the form factor may allow a simplification of the electrode design by using the flighting of the auger as the negative electrode;
- it may enhance product quality (e.g. through agitation) and may allow for easier system optimization; and
- it may be more easily scalable.

In addition to the container housing the terminal pairs, the apparatus in this case comprises a bulk separator to allow final separation of the components after shock treatment. In this case, the bulk separator receives the processed mixture from the container outlet. At this point, additional water may be provided via water inlet 680.

Due to the differences in the density of the sand compared with the aqueous phase, the sand sinks quickly to the bottom where it can be removed from sand outlet 681.

After the sand has been removed, the remaining product comprises hydrocarbons and water. Due to the treatment process, the oil may have formed small droplets forming an emulsion with the water. To aggregate the oil droplets, the bulk separator may comprise a coalescer 682. In this case the coalescer is a polypropylene coalescer 682 comprising a matrix of polypropylene fibers designed to coalesce oil droplets. Other coalescers may be used. By forming larger droplets of oil, the droplets will float to the top due to density differences. From there, an oil skimmer 683 directs the oil at the top towards an oil outlet. The remaining water goes to the bottom where it is removed by water outlet 685.

Twin-Auger Enclosed Embodiment

Figure 7A:
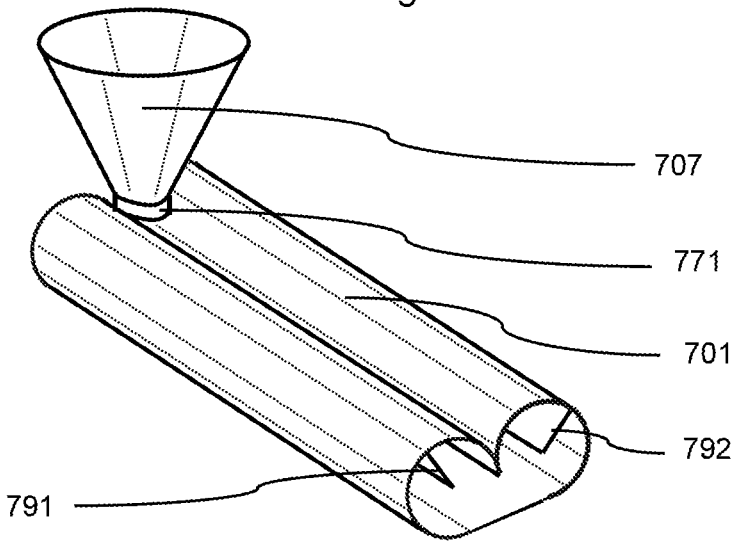
FIG. 7*a* is a perspective view of a further separator apparatus for separating hydrocarbons from solid particles using a shockwave.
Figure 7B:
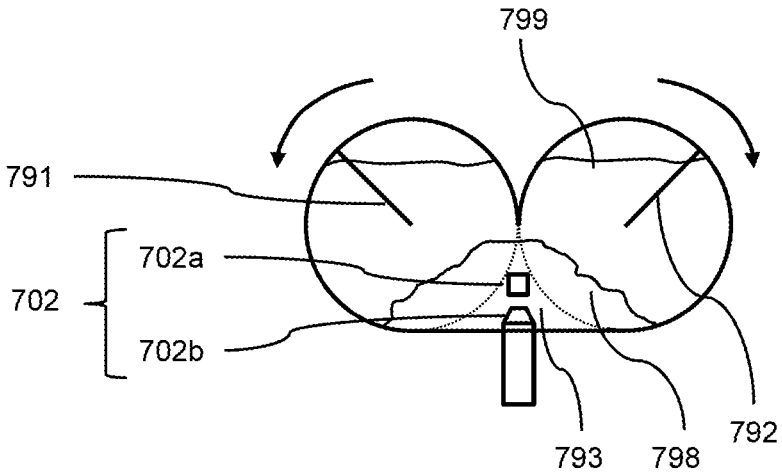
FIG. 7*b* is a transverse cross-section view of the separator apparatus of FIG. 7*a*.
Figure 7C:
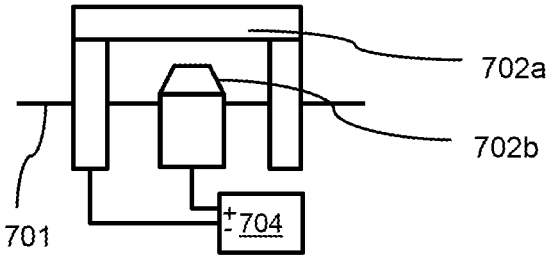
FIG. 7*c* is a partial longitudinal cross-section view of a terminal pair of the separator apparatus of FIG. 7*a*.

FIG. 7*a* shows an embodiment of a separator apparatus 700 for separating hydrocarbons from solid particles in a hydrocarbon-particulate-aqueous mixture. FIG. 7*b* is a transverse cross-section of the separator. FIG. 7*c* is a longitudinal cross-section of a portion of the separator highlighting the terminal pair arrangement.

In this case, the apparatus comprises:

a container 701 (in this case an elongate channel housing two augers) for containing the hydrocarbon-particulate-aqueous mixture;

a shockwave generator comprising a terminal pair 702 having a positive 702*b* and a negative 702*a* electrical terminal; and a pulsed power supply 704 configured to apply a voltage pulse between the positive and negative electrical terminals 702*a,b,* the apparatus being configured such that, when a voltage pulse is applied to the positive and negative electrical terminals, a shockwave is generated in the mixture to promote separation of the components of the mixture.

In this case, the pipe container comprises an inlet 707 for introducing product into the container 701 (e.g. in a continuous manner). As noted above, the container 701 houses two augers 791, 792. The container 701 is configured to enclose the two auger flightings 791, 792 around most of the flightings circumference (e.g. 270° as shown in FIG. 7*b*). This helps ensures that the flighting can move substantially all the material within the container along the containers longitudinal axis. However, in this case, there is an interaction region 793 between the two auger flightings where the container does not follow the auger flightings' circumferences. This interaction region 793 extends between the bottom halves of the two auger flightings 791, 792 and houses the terminal pairs 702*a,b* which are arranged longitudinally along the container axis. It will be appreciated that the interaction region between the augers is a region in which the shockwave is generated; however, the effects of the shockwave may extend beyond this region into the volumes swept by the auger flightings.

Figure 7D:
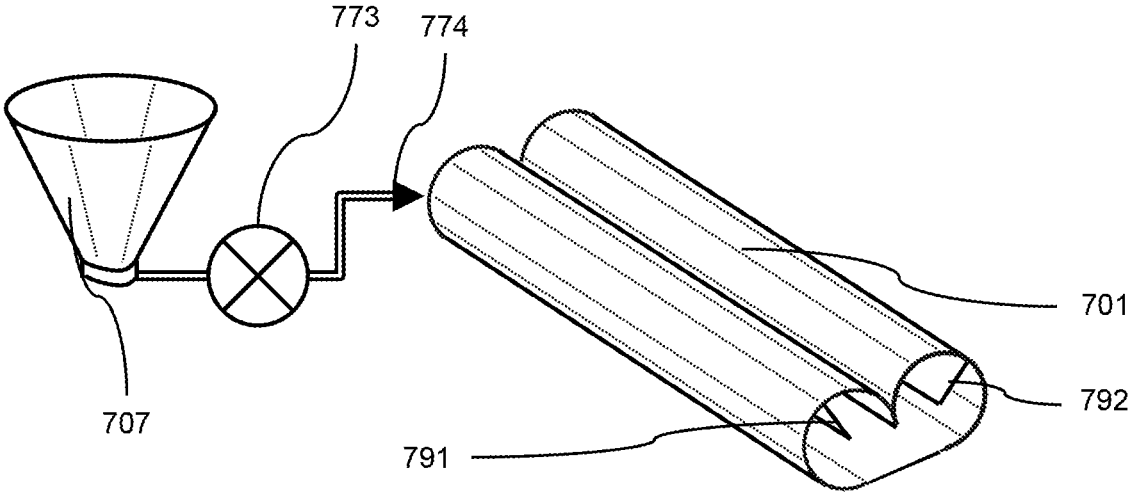
FIG. 7*d* is a is a perspective view of a variant of the separator apparatus of FIG. 7*a*.

If utilizing gravity forces, there is a metering 'gate' 771 placed between 701 and 707 which controls the material entering the twin augers at precise flowrates. A further embodiment (shown in FIG. 7*d*) allows 707 to be moved and connected to 701 by a pump 773 and pressure piping 774 system that also provides precise metering of material into 701.

The augers in this case have opposite handedness and are configured to rotate in phase in opposite directions as shown by the curved arrows in FIG. 7*b*. This maintains symmetry through a rotation cycle about a mirror plane aligned with the longitudinal axis of the container. In particular, because the augers are configured to rotate such that the inner portions of the augers are moving upwards, the solid material at the bottom of the two augers are impelled towards the interaction region 793 between the two augers. This helps ensure that the shock waves generated within the interaction regions are more efficiently coupled with the solid sand-hydrocarbon components 798 of the mixture. The liquid components 799 of the mixture will flow more easily and so will form a more even level within the container. They may be operated out of phase so not mirror images.

Each auger, in this case, is 9" diameter. Each auger may be configured to move 0.5 $m^3$/hr or more of 1,500-2,100 kg/$m^3$ slurry (hydrocarbon-particulate-aqueous mixture) at approximately 95% container loading. The material may have a retention time in the container of between 10 and 30 minutes (e.g. 20 min). It will be appreciated that, because the system is scalable, other design configurations (e.g. different diameter, length, auger helix angle etc.) are available depending on the desired outcomes. The apparatus, in this case, is generally formed from steel (e.g. stainless steel).

Unlike the previous embodiment, the auger flightings are not one of the terminals (although other embodiments may be configured such that the flighting is one of the terminals). In this case, the electrodes 702*a*, 702*b* are positioned within the interaction zone between the auger flightings 792, 793 as shown in FIGS. 7*b* and 7*c*. In this case, the negative (or ground) terminal 702*a* is an elongate electrode positioned above a point positive terminal 702*b*. The negative electrode is mounted on a bridging structure which connects the electrode to the pulsed power supply 704. It will be appreciated that there may be multiple electrodes arranged longitudinally along the interaction zone. It will be appreciated that the container itself may be grounded to earth.

In this case, the augers 791,792 are driven by driveshafts in order to move the product along the container and to agitate the product to aid separation. In this case, the augers and driveshaft are in an inclined configuration. The augers can also be operated in a declined orientation. It will be appreciated that rotation of each auger can be used to control flow within the container. For example, each auger may run in a continuous mode to translate the mixture through the container at a fixed rate. The auger may be configured to pause to restrict flow. Each auger may be run in a retrograde mode to create further agitation (flow towards the outlet may still occur in the gap below the auger). The augers may have the same or different handedness. The augers may be configured to rotate in phase. The augers may be configured to rotate at the same speed out of phase. This may induce a transverse reciprocal motion to material in the interaction zone between the two flightings. These modes may be used interchangeably. For example, different modes may be employed depending on detected ratios between the various components in the mixture and/or operating conditions (e.g. temperature).

The pitch of the auger flighting and diameter of the auger may or may not be constant across its length (e.g. from inlet to outlet). In addition, in a vertical or horizontal, batch or continuous modes, fluid flow may be introduced at the bottom that could aid in washing the sand and floating the oil/bitumen off the top. For example, the introduced water may form a fluidized bed that suspends the solids.

It will be appreciated that the auger apparatus may operate at any angle between horizontal (zero degrees) and vertical (90 degrees from horizontal). When operating in a vertical mode, the gap between the auger flighting and the container wall may be smaller.

It will be appreciated that this embodiment may have some of the optional features described with respect to the embodiment of FIG. 6 (e.g. additional water nozzles etc.).

Continuous Separation System

Figure 8:
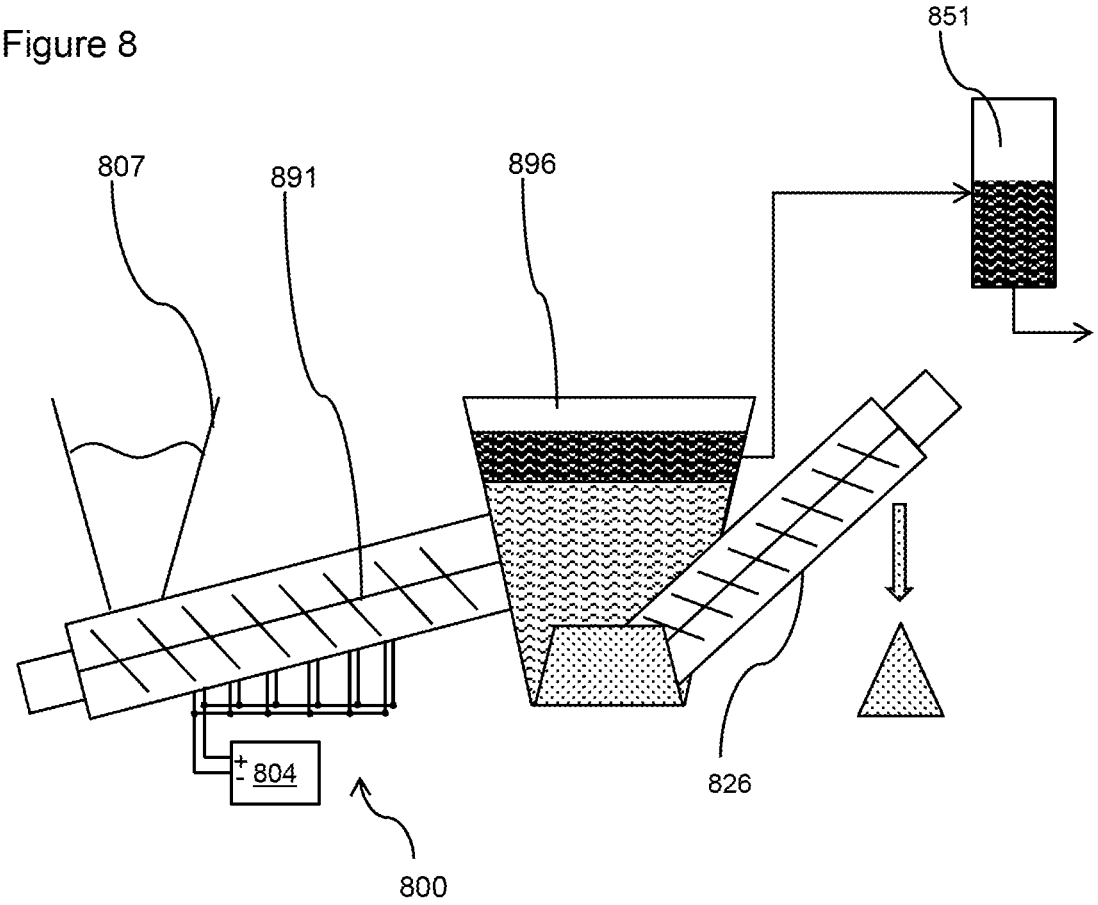
FIG. 8 is a schematic of a system for separating hydrocarbons from solid particles using a shockwave generated by an ionic bridge.

Using embodiments such as those described in relation to FIGS. 6*a* and 7*a* allow the method to be performed on a continuous basis. This may streamline the process. FIG. 8 shows an embodiment configured to allow continuous separation of the various components of a hydrocarbon-particulate-aqueous mixture.

In this case, the separator comprises an auger based separator 800 which is configured to receive the hydrocarbon-particulate-aqueous mixture via inlet 807. The auger then moves the mixture whilst the separator applies shocks (generated by controller 804) to the mixture to separate the mixture into its constituent components.

In order to allow macroscopic separation of the separated components, the separated components are delivered to a settling tank 896. When the hydrocarbon has been separated from the solid particles, the hydrocarbons float to the top of the container as they are less dense than water. In contrast, the solid particles, which are denser than water, sink to the bottom of the settling tank 896. This may facilitate continuous processing as the solid particles may be extracted from the bottom of the container and the hydrocarbons from the top as new hydrocarbon-particulate mixture is added to the container. The level of the inlet 807 may be at least as high as the level of fluid in the settling tank 896 to help contain the liquid within the system.

In this case, the oil floating on the top of the settling tank is extracted to a holding tank 851.

The sand settled at the bottom of the settling tank is extracted using a sand separator 826 which has a second auger. As with the embodiment of FIG. 2, in this embodiment additional water may be added to the sand separator 826 to further clean the sand to be separated.

It will be appreciated that the sand separator 826 may allow the sand and water to me removed from the system (i.e. so that the system processes the initial mixture in a single pass) or allow some of the material (e.g. the liquid component) to be returned to the inlet 807 to allow the system to operate in a multiple pass mode.

Twin-Auger Embodiment with Planar Terminal Pairs

Figure 9A:
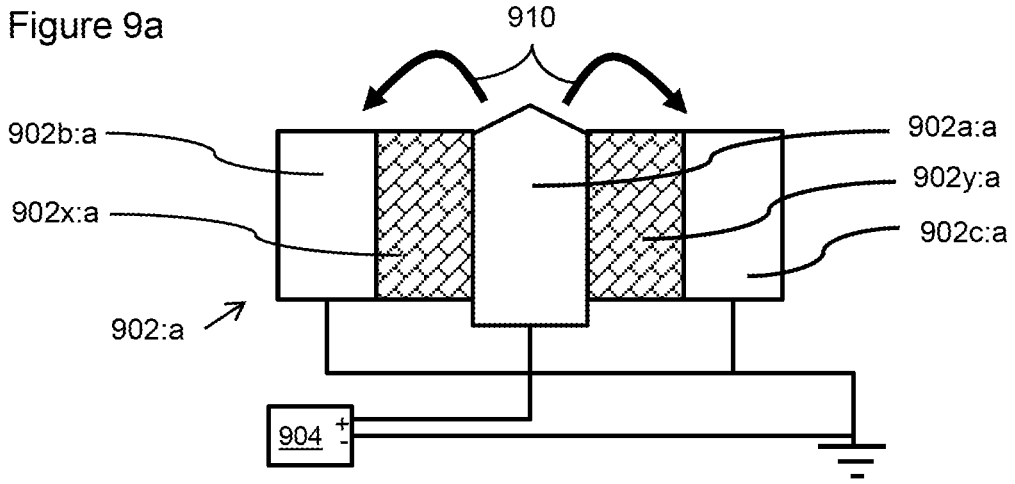
FIG. 9*a* is a cross-sectional view of a further planar terminal pair arrangement.

FIG. 9*a* shows an alternative terminal pair configuration 902*:a*. In this case, the positive 902*a:a* and negative terminals 902*b:a*, 902*c:a* are arranged in the same plane separated by insulators 902*x:a*, 902*y:a*. This arrangement may be considered a planar or button terminal pair. By varying the voltage on the electrode and insulator thickness discharge properties of an arc 910 may be controlled in the aqueous mixture adjacent to the electrode. It will be appreciated that one of the electrodes in the pair may protrude beyond the insulating material. For example, in the embodiment shown in FIG. 9*a*, the central electrode protrudes beyond the insulating material. This may help allow the current arc to be formed generating the shockwave.

When the terminals are charged, the charge cannot flow through the insulator so the terminals discharge 910 into the mixture at the uninsulated ends of the terminals within the mixture. This creates a shockwave to separate the mixture into the constituent components. In this case, the "negative" terminals 902*b:a*, 902*c:a* are grounded to earth.

Figure 9B:
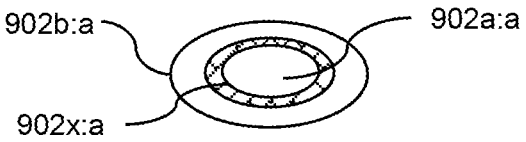
FIGS. 9*b* and 9*c* are top perspective views of arrangements of planar terminal pairs.
Figure 9C:
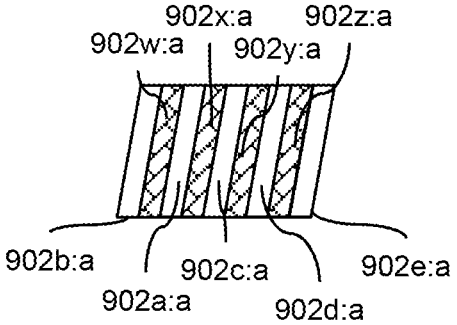

FIGS. 9*b* and 9*c* show perspective views of two possible configurations of planar terminal pairs. Planar terminal pairs may be rotationally symmetric about a central terminal (forming a button shape as shown in FIG. 9*b*). For example, as shown in FIG. 9*a*, the positive terminal 902*a:a* is the central terminal surrounded by an insulator portion 902*x:a* and a negative terminal 902*b:a*.

Planar terminal pairs may form an extended array with multiple positive 902*a:a*, 902*a:e* and negative 902*b:a*, 902*c:a*, 902*e:a* electrodes separated by insulator portions 902*w:a*,

902x:a, 902y:a, 902z:a as shown in FIG. 9c. It will be appreciated that other two-dimensional planar arrays may be used.

An advantage of this construction of terminal is that the terminal may lie flush with the surface of the container. This may make cleaning easier and prevent the terminals affecting moving parts within the container (e.g. augers or agitators).

Figure 9D:
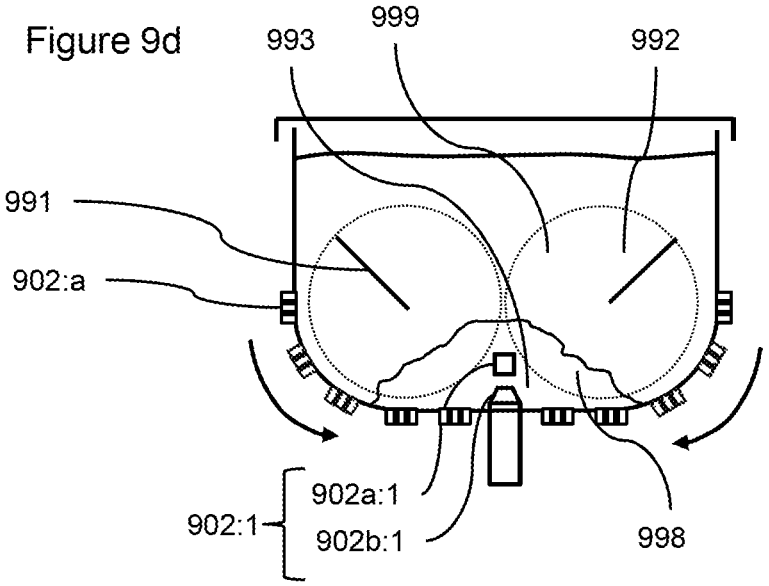
FIG. 9*d* is a transverse cross-section view of a further separator apparatus for separating hydrocarbons from solid particles using a shockwave.

FIG. 9d is a transverse cross-section of an embodiment of a separator apparatus 900 for separating hydrocarbons from solid particles in a hydrocarbon-particulate-aqueous mixture and which uses terminal pairs as described with respect to FIG. 9a.

In this case, the apparatus comprises:

a container 901 (in this case an elongate channel housing two augers) for containing the hydrocarbon-particulate-aqueous mixture;

a shockwave generator comprising multiple terminal pairs 902:1,902:a having a positive and a negative electrical terminal; and a pulsed power supply 904 configured to apply a voltage pulse between the positive and negative electrical terminals 902a,b, the apparatus being configured such that, when a voltage pulse is applied to the positive and negative electrical terminals, a shockwave is generated in the mixture to promote separation of the components of the mixture.

The container 901, in this case, houses two augers 991, 992. Unlike the embodiment of FIG. 7, in this case, the container 901 is configured to enclose the two auger flightings 991, 992 only around a bottom portion of the flightings circumference (e.g. ~90° as shown in FIG. 9d. Embodiments with tapering container walls (e.g. 'V' shaped) may enclose less than 90° of the auger. Enclosing the bottom outside of the auger flighting helps ensure that the flighting can move substantially all the material within the container along the containers longitudinal axis.

In addition, unlike the embodiment of FIG. 7, the container walls extend upwards (e.g. vertically in this case although inclined walls are also possible) such that there is significant volume of liquid above the auger flightings. This additional "attic" or "overhead" volume of liquid may help prevent any floating separated oil/bitumen from being reintroduced into the mixture as the auger rotates. In this embodiment, the augers primary use is to transport rather than to agitate so low RPM is will be used.

In this case, there is an interaction region 993 between the two auger flightings where the container bottom does not follow the auger flightings' circumferences. This interaction region 993 extends between the bottom halves of the two auger flightings 991, 992 and houses opposed terminal pairs 902a:1, 902b:1 which are arranged longitudinally along the container axis. The opposed terminal pairs are arranged such that the mixture can pass directly between the positive and negative terminals. It will be appreciated that the interaction region between the augers is a region in which a shockwave is generated; however, the effects of the shockwave may extend beyond this region into the volumes swept by the auger flightings.

In addition to the opposed terminal pair 902:1, this embodiment comprises an array of planar terminal pairs 902:a (ten planar terminal pairs are shown in FIG. 9d). The planar terminal pairs are arranged along the bottom of the container opposite the auger flightings.

The augers in this case have opposite handedness and are configured to rotate in phase in opposite directions as shown by the curved arrows in FIG. 9d. This maintains symmetry through a rotation cycle about a mirror plane aligned with the longitudinal axis of the container. In particular, because the augers are configured to rotate such that the inner portions of the augers are moving upwards, the solid material at the bottom of the two augers are impelled towards the interaction region 993 between the two augers. This helps ensure that the shock waves generated within the interaction regions are more efficiently coupled with the solid sand-hydrocarbon components 998 of the mixture. The liquid components 999 of the mixture will flow more easily and so will form a more even level within the container. They may be operated out of phase so not mirror images.

Each auger, in this case, is 9" diameter. Each auger may be configured to move 0.5 $m^3$/hr or more of 1,500-2,100 kg/$m^3$ slurry (hydrocarbon-particulate-aqueous mixture) at approximately 95% container loading. The material may have a retention time in the container of between 10 and 30 minutes (e.g. 20 min). It will be appreciated that, because the system is scalable, other design configurations (e.g. different diameter, length, auger helix angle etc.) are available depending on the desired outcomes. The apparatus, in this case, is generally formed from steel (e.g. stainless steel).

As with the embodiment of FIG. 7, different auger modes may be employed depending on detected ratios between the various components in the mixture and/or operating conditions (e.g. temperature).

It will be appreciated that this embodiment may have some of the optional features described with respect to the embodiment of FIG. 6 (e.g. additional water nozzles etc.).

Other Options

It will be appreciated that auger embodiments (e.g. FIGS. 7a and 9d) may have different configurations. For example, the auger flighting may be a ribbon flighting (e.g. for use in very thick viscous mixtures). The auger may be shaftless.

Other options include that the terminals may be placed on the housing or container in any spatial array. For example, the terminals may or may not conform to a single linear line. The spatial separation between neighbouring electrodes may be different.

In multiple-terminal-pair embodiments, the energy deposition (e.g. pulsing strategy) along the length of the augers may not be linear, but may be normally distributed, left or right biased or bi modal to effect energy efficient separation and clean solids.

The liquid flow in above the augers may be either counter current or concurrent with the solids transport flow in the augers.

The auger can be operated in a negative angle (i.e. pushing solids downhill); a zero angle (horizontal) to a positive (uphill) angle up to 90° (vertical)

Flotation aids can be introduced at any low point along the vertical length of the auger.

It will be appreciated that opposed terminal pairs may also be used outside anywhere outside the volume swept out by any auger flightings. For example, in the embodiment of FIG. 9d, opposed terminal pairs may be used in the gap between the auger flightings and the container walls and/or in the volume above the auger flightings.

Further Explanation of Terms

The hydrocarbons may comprise heavy hydrocarbons such as bitumen. Heavy hydrocarbons may be defined as hydrocarbons which can be distilled at temperatures above 350° C. and/or have an API gravity less than 22.3 (density greater than 920 kg/$m^3$). The hydrocarbons may be the product of an oil reservoir (native hydrocarbons) or may be introduced into a well (non-native hydrocarbons such as oil-based mud (OBM) or other drilling fluids).

The hydrocarbons may include medium hydrocarbons and/or light hydrocarbons. Medium hydrocarbons may be defined as hydrocarbons which can be distilled between temperatures of 200° C. and 350° C. and are generally defined as having an API gravity between 22.3 API and 31.1 API (870 to 920 kg/m$^3$). Light hydrocarbons may be defined as hydrocarbons which can be distilled below 200° C. and a generally defined as having an API gravity higher than 31.1 API (less than 870 kg/m$^3$).

The solid particles may comprise drill cuttings. The solid particles may comprise minerals. It will be appreciated that the minerals may comprise one or more mineral. A mineral may be representable by a chemical formula. The minerals may form part of a rock component. A mineral may be formed of inorganic compounds. The particles may be insoluble in water and/or liquid hydrocarbon. The minerals may comprise silicon dioxide sand. The solid particles may comprise rock fragments and/or clastics.

The minerals may comprise carbonates. That is, this technique may also be used where the hydrocarbons are in a carbonate formation (limestone or dolomite). This technique may be particularly suited to carbonate formations, as using significant amounts of heat and chemicals with carbonates in an aqueous environment may cause detrimental chemical reactions in the hydrocarbon-aqueous-solids mixture which may make hydrocarbon extraction more difficult.

The solid particles may comprise one or more of: fine silt; medium silt; coarse silt; fine sand; medium sand; coarse sand; fine gravel; medium gravel and coarse gravel. These terms correspond to sizes defined in international standard ISO 14688-1:2002. The solid particles may have a minimum dimension less than ⅕th of the inter-electrode spacing. The solid particles may be denser than water. The solid particles may be of sufficient size and density that they sink to the bottom of the aqueous phase when separated from the hydrocarbons.

A high-voltage pulsed power supply may be considered to be a power supply configured to produce a voltage pulse with a peak voltage of greater than 17 kV. A medium-voltage pulsed power supply may be considered to be a power supply configured to produce a voltage pulse with a peak voltage of between 5-12 kV.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. An apparatus for separating hydrocarbons from solid particles in a hydrocarbon-particulate-aqueous mixture, the apparatus comprising:

a container for containing the hydrocarbon-particulate-aqueous mixture;

two augers for moving the hydrocarbon-particulate-aqueous mixture within the container, wherein an interaction region is formed in a space between bottom halves of the two augers and a bottom of the container, relative to a longitudinal axis of the container;

a shockwave generator comprising an electrical terminal pair, the electrical terminal pair being located within the interaction region within the container; and a pulsed power supply configured to apply one or more voltage pulses to the electrical terminal pair;

the apparatus being configured such that, when a voltage pulse of said one or more voltage pulses is applied to the electrical terminal pair, a shockwave is generated within the interaction region in the hydrocarbon-particulate-aqueous mixture to promote separation of components of the hydrocarbon-particulate-aqueous mixture.

2. The apparatus of claim 1, wherein the electrical terminal pair comprises an electrode pair having a positive and a negative electrode positioned within the container and separated by a gap, such that, when said voltage pulse is applied to the electrical terminal pair, a plasma arc is generated between the electrodes which applies the shockwave to the hydrocarbon-particulate-aqueous mixture.

3. The apparatus of claim 1, wherein each of the one or more voltage pulses has a voltage of between 5 kV and 18 kV.

4. The apparatus of claim 1, wherein the pulsed power supply and terminals are configured to apply a voltage gradient between the terminals in the electrical terminal pair of between 39.4 kV/cm and 9.8 kV/cm.

5. The apparatus of claim 1, wherein the shockwave generator comprises an ionic bridge injector configured to inject a solution of ionic solution between the electrical terminal pair of the shockwave generator such that, when the voltage pulse of said one or more voltage pulses is applied to the mixture, a plasma arc is generated between the electrical terminal pair which applies the shockwave to the mixture.

6. The apparatus of claim 5, wherein the ionic bridge injector is configured to repeatedly inject a volume of ionic material to enable successive shockwaves to be generated by the shockwave generator.

7. The apparatus of claim 1, wherein the apparatus comprises multiple electrical terminal pairs.

8. The apparatus of claim 1, wherein the pulsed power supply and terminals are configured to provide the voltage pulse of said one or more voltage pulses, the voltage pulse of said one or more voltage pulses having an energy of at least 500 J.

9. The apparatus of claim 1, wherein the apparatus is configured to apply a series of shockwaves to the hydrocarbon-particulate-aqueous mixture.

10. The apparatus of claim 9, wherein the pulsed power supply is configured to provide a temporal separation between successive shockwaves of at most 5 seconds.

11. The apparatus of claim 1, wherein the pulsed power supply and terminals are configured to provide the voltage pulse of said one or more voltage pulses with a leading edge of less than 3 μs.

12. The apparatus of claim 1, wherein the container is an elongate channel housing the two augers.

13. The apparatus of claim 1, wherein the apparatus comprises the two augers with opposite handedness.

14. The apparatus of claim 1, wherein the apparatus comprises multiple electrical terminal pairs arranged longitudinally along the interaction region.

15. The apparatus of claim 1, wherein the augers are configured to operate in an inclined configuration.

16. The apparatus of claim 1, wherein the container is configured to enclose the augers around at least part of a circumference of the augers.

17. The apparatus of claim 1, wherein each auger is mounted on a driveshaft, and wherein each auger is configured independently to be operated in one of the following modes: a retrograde mode, a continuous mode, and a pause mode.

18. The apparatus of claim 1, wherein the two augers are configured to rotate at a same speed out of phase with each other in order to induce a transverse reciprocal motion to the hydrocarbon-particulate-aqueous mixture between the two augers.

19. The apparatus of claim 1, wherein the two augers are configured to rotate such that the inner portions of the two augers, relative to the longitudinal axis, move upwards and solid material of the hydrocarbon-particulate-aqueous mixture at the bottom of the two augers are impelled towards the interaction region.

* * * * *